US005386781A

United States Patent [19]

Day

[11] Patent Number: 5,386,781

[45] Date of Patent: Feb. 7, 1995

[54] PARACHUTE DEPLOYMENT SYSTEM

[75] Inventor: Evan E. Day, Brigham City, Utah

[73] Assignee: Thiokol Corporation, Ogden, Utah

[21] Appl. No.: 976,207

[22] Filed: Nov. 12, 1992

[51] Int. Cl.[6] ..... F42B 4/28

[52] U.S. Cl. ..... 102/340; 102/337; 102/348; 102/374; 102/387

[58] Field of Search ..... 102/334, 336–340, 102/342, 345, 348, 351, 352, 354, 357, 374, 386–388, 393, 489

[56] References Cited

U.S. PATENT DOCUMENTS

| | | | |
|---|---|---|---|
| 1,621,421 | 3/1927 | Kunzer | 102/34 |
| 1,817,503 | 8/1931 | Anderson | 102/34 |
| 2,271,224 | 1/1942 | Goddard . | |
| 2,394,896 | 2/1946 | Cavanagh | 102/35.6 |
| 2,394,897 | 2/1946 | Cavanagh | 102/35.6 |
| 3,055,300 | 9/1962 | Stocke . | |
| 3,113,752 | 12/1963 | Brestel | 244/147 |
| 3,221,656 | 12/1965 | Sutten | 102/34.1 |
| 3,515,362 | 6/1970 | Richardson et al. | 244/142 |
| 3,593,664 | 7/1971 | Davis et al. | 102/35.6 |
| 3,605,624 | 8/1971 | Dinsdale et al. | 102/37.8 |
| 3,706,257 | 12/1972 | Collman | 86/20 R |
| 3,712,232 | 1/1973 | Abel et al. | 102/85.2 |
| 3,723,206 | 3/1973 | Dinsdale et al. | 149/19 |
| 3,736,877 | 6/1973 | Roberts et al. | 102/35 |
| 3,752,077 | 8/1973 | Roberts et al. | 102/35 |
| 3,773,284 | 11/1973 | Matsuo et al. | 244/142 |
| 3,829,046 | 8/1974 | Matsuo et al. | 244/152 |
| 3,908,938 | 9/1975 | Pravaz | 244/152 |
| 3,946,672 | 3/1976 | Adams et al. | 102/49.4 |
| 4,029,014 | 6/1977 | Cunningham | 102/35 |
| 4,226,185 | 10/1980 | Tobler et al. . | |
| 4,649,826 | 3/1987 | Stevens | 102/340 |
| 4,765,247 | 8/1988 | Sorenson et al. | 102/339 |
| 5,054,398 | 10/1991 | Dobler et al. | 102/489 |
| 5,239,927 | 8/1993 | Frye et al. | 102/387 |

FOREIGN PATENT DOCUMENTS

| | | | |
|---|---|---|---|
| 899496 | 6/1962 | United Kingdom | 102/348 |
| 1179804 | 2/1970 | United Kingdom | 102/339 |
| 1198989 | 7/1970 | United Kingdom | 102/337 |

OTHER PUBLICATIONS

*M-257 Standoff Illuminating Flare* [product brochure], Thiokol Corporation, Brigham City, Utah (date unknown).

*LUU-2B/B Aircraft-Deployed Illuminating Flare* [product brochure], Thiokol corporation, Brigham City, Utah (date unkonw).

*Primary Examiner*—Harold J. Tudor

*Attorney, Agent, or Firm*—Madson & Metcalf

[57] ABSTRACT

A parachute deployment system for use with an illuminating flare warhead propelled by a rocket motor. The system employs a compact two-stage parachute system which includes a main parachute arranged within a main parachute cover and a drogue parachute arranged within a drogue chute cover. The main parachute pack and the drogue parachute are configured to be positioned in a side-by-side, detached relationship within the warhead. An extraction line separably connects the drogue parachute pack to the rocket motor and a support line connects the drogue parachute pack to the main parachute pack such that upon separation of the rocket motor from the warhead, the drogue parachute pack is extracted from the warhead prior to extraction of the main parachute pack. Upon deployment of the drogue parachute, the drogue parachute cover remains attached to the extraction line and acts as a deflector, inducing radial forces which act upon the rocket motor to prevent it from colliding into the warhead.

25 Claims, 17 Drawing Sheets

PARACHUTE DEPLOYMENT SYSTEM

BACKGROUND

1. The Field of the Invention

The present invention is related to a parachute deployment system for use with a rocket-motor propelled warhead. More particularly, the present invention is related to a parachute deployment system which implements the use of a main parachute pack and a drogue parachute pack for use with an illuminating flare warhead.

2. Technical Background

Flares of various types have found useful application to accomplish a variety of purposes. For military purposes, for example, it is often desirable to light a particular area at night. A flare may be used to produce light for search and rescue operations, or for various other military purposes. When used in these applications, flares are typically mounted to a rocket motor and launched to a predetermined target area. A parachute is generally mounted to the flare and designed to deploy over the target area, thereby permitting the flare to slowly descend while emitting light.

Typical of prior-art flares is the M-257 Standoff Illuminating Flare, made for the U.S. Army, and designated generally at 10 in FIGS. 1 through 4. As illustrated in FIG. 1, the end of the flare 10 includes a motor adapter 12 upon which a rocket motor may be threadably attached. The flare 10 further includes a fuse 14, a drogue parachute 16, a main parachute 18, flare illuminant 20 and an illuminant ignition system 22.

Fuse 14, housed within the motor adapter 12, is armed upon initial acceleration of the rocket motor. The M-257 employs what is commonly referred to as a "setback fuse" which includes a slider 24 which is of sufficient mass that it compresses a spring 26 upon initial acceleration of the rocket motor. Rocket motors commonly employed in propelling such flares generally have an initial acceleration of about 60 g-forces (approximately 770 $m/s^2$) over a period of about one second.

Upon burn-out of the rocket motor, the slider 24 is forced back to the position illustrated in FIG. 1 by the extension force of the spring 26. Upon reaching the end of its travel, the slider 24 releases a firing pin which fires a primer cap (not shown). The primer cap is positioned contiguous a pyrotechnic delay column (not shown) such that firing of the primer cap ignites the delay column. The delay column burns for a predetermined period of time, generally about nine seconds, while the flare is coasting through the air. While coasting, the flare slows from its maximum velocity of about 2200 ft/sec to about 750 ft/sec.

At the base of the delay column is positioned a propellant wafer 28 which acts as the first separation charge. Upon burnout of the delay column, the separation charge is ignited. The firing of the separation charge results in the buildup of a pressure of approximately 5,000 psi. Upon ignition of the propellant wafer 28, a pusher plate 32 bears against the aft end of the drogue parachute housing 34, thereby tending to separate the warhead from the rocket motor. The force of separation resulting from the internal pressure buildup causes shear pins 30 which attach the motor adapter 12 to the remainder of the flare to shear. Upon the shearing of shear pins 30, the motor adapter 12 and rocket motor are released from the warhead, as illustrated in FIG. 2.

Upon separation, the pusher plate 32 falls away from the main parachute housing and becomes subject to the substantial resistance forces imposed by the atmosphere. The pusher plate 32 is attached to the drogue chute 16. Hence, the force of air resistance on the pusher plate 32 pulls the drogue chute 16 out of the housing 34 and permits it to inflate.

At the same time, a deflector plate 36, attached to the motor adapter 12, falls off to the side of the motor adapter 12. The force of air resistance acting on the deflector plate 36 causes the deflector plate 36 to function as a drogue and alter the trajectory of the combined motor adapter 12 and the rocket motor, thereby assisting to prevent the possible collision of the rocket motor with the flare. In practice, however, the deflector plate 36 does not always induce adequate lateral forces on the rocket motor and collision with the flare occasionally does occur.

With continued reference to FIG. 2, a gas generator 38, mounted within the parachute housing 34, is ignited upon deployment of the drogue parachute 16. A nylon cord or wire 40 connects the bridle 42 of the drogue parachute 16 to a "quick match" 44 located inside the gas generator 38. The cord or wire 40 is shorter than the main drogue line 46; thus, as the droque parachute deploys, the quick match 44 is pulled out of the gas generator 38 and ignition of the generator is effected.

The gas generator 38 acts as a delay to control how long the drogue parachute is deployed. In the M-257 standard flare, the gas generator 38 provides an approximate two-second delay. The head end of the gas generator 38 is positioned contiguous a propellant wafer 48 which functions as a secondary separation charge. Thus, as the gas generator 38 burns out, it ignites the propellant wafer 48.

In the M-257, the secondary separation charge generates an internal pressure of about 10,000 psi. This pressure causes a second pusher plate 50 to bear against the aft end of the main parachute housing 52 and results in the shearing of shear pins 54 which attach the drogue chute housing 34 to the main chute housing 52. As the shear pins 54 are broken, the drogue chute 16 and the drogue chute housing 34 are separated from the remainder of the flare, as illustrated in FIG. 3.

The second pusher plate 50 then falls out and is exposed at high speed to the atmosphere. The resulting force of air resistance on the second pusher plate 50 deploys a pilot parachute 56 to which the second pusher plate 50 is attached.

The pilot parachute 56 is connected to a main parachute container 58 in which the main parachute 18 is housed. The force on the main parachute container 58 resulting from the deployment of the pilot parachute 56 causes the main parachute container 58 to be extracted from the main parachute housing 52. As the line 60 connecting the pilot chute 56 to the main parachute housing 52 and the main parachute line 62 are fully extended, the force of the resulting jerk is sufficient to break the cotton ties 64 which hold the main chute 18 within the main chute container 58. As the cotton ties 64 break, the main parachute 18 is deployed, as illustrated in FIG. 4. With the main parachute deployed, the flare descends at an approximate rate of 13 ft/sec.

The flare ignition system 22, as illustrated in FIG. 1, is armed upon initial acceleration of the flare. The forces due to the acceleration of the flare cause a "zig zag" safety block 70 to compress a spring 72. The safety block 70 and spring 72 are concentrically mounted about a mounting column. The safety block 70 includes a pawl which rides in a zig-zag shaped track located within the mounting column. In order for the safety block to follow the track and completely compress the spring, the flare must have an acceleration of 22 g-forces over a period of about one second. Thus, should the rocket motor malfunction and not fully accelerate, the flare ignition system will not arm.

Once armed, the flare is ignited by pulling an ignition lanyard 74. The ignition lanyard is attached at one end to the main chute line 62 and at the other end to the ignition system 22. The ignition lanyard passes from the main chute line to the ignition system along a raceway between the illuminant 20 and the canister. Within the ignition system 22, the lanyard is attached to a slider 78.

Upon deployment of the main parachute 18 (FIG. 3), the ignition lanyard 74 is pulled, causing the slider 78 to move across its track. A hammer (not shown) is retracted against a spring as the slider 78 is pulled across its track. As the slider 78 reaches the end of its track, the hammer is released and, under the force of the spring, strikes a primer cap which fires into a pellet basket 80 containing a number of $BKNO_3$ pellets.

As best viewed in FIG. 1, a layer of foam 82 serves to tightly pack the pellets as a guard against vibration of the pellets. As the pellets burn, the heat from the pellets ignites the propellant wafer 84.. Ignition of the pellets and wafer 84 generates sufficient heat to ignite the flare illuminant 20 at the head end of the flare. Additionally, the internal gas pressure generated upon ignition of the wafer 84 blows the ignition system 22 off of the flare (FIG. 4), leaving the flare open to the atmosphere and permitting the approximate 1 million candle power of light generated by the flare to shine out of the flare canister and onto the area to be illuminated.

One of the principal disadvantages of the M-257 flare is its size. The M-257 is 31.6 inches long. It is often desirable to launch flares out of standardized rocket launchers, such as those carried by military aircraft. Unlike most standardized 70 mm warheads, the M-257 extends about eight inches out of the launcher, precluding the use of aerodynamic fairings on the launcher to improve aircraft performance and protect the payload from environmental and electronic radiation hazards. Additionally, the length of the M-257 prohibits the use of standardized 70 mm packaging and logistic system with the flare.

Launching a warhead out of such a rocket launcher works best if the warhead is less than 27 inches long. In some applications, it is desirable to include a nose cone on the warhead, as opposed to the blunt head of the M-257 , to enhance the aerodynamics of the warhead. Adding a nose cone, of course, increases the length of the warhead.

One way of reducing the length of the flare warhead is to reduce the amount of illuminant contained within the flare. This solution is obviously disadvantageous because it significantly effects the performance of the warhead. Most standardized flares are designed to produce 120 seconds of continuous illumination at one million candlepower of intensity. It would be most advantageous if these performance parameters could be maintained.

The M-257 is designed to work with a fixed-delay fuse. This fuse provides a constant delay of 13.5 seconds from launch to flare ignition. This corresponds to a fixed standoff range of about 4,200 meters from launcher to target and a fixed parachute deployment velocity of 250 m/sec.

In recent years, however, the demand for a variable range flare has resulted in the development of variable delay fuses. The range of the flare is thus controlled by utilizing a fuse which can vary the time between when the rocket motor fires and when the drogue parachute deploys.

Consequently, in flare warheads employing variable delay fuses, the parachutes must be capable of being deployed over a wide range of velocities. However, at particularly low velocities, the force on the ignition lanyard resulting from the deployment of the main parachute may be insufficient to trigger the firing of the ignition system. Additionally, at high velocities, the extreme jerk on the ignition lanyard frequently results in the lanyard being broken without pulling the slider and triggering ignition of the ignition system.

It would, therefore, be an advancement in the art to provide a parachute deployment system which incorporated an improved rocket motor deflector to thereby ensure that the rocket motor would not collide with the flare following its separation from the flare.

Indeed, it would be an advancement in the art to provide an improved parachute deployment system which would enable the overall length of the warhead to be reduced without reducing the amount of illuminant included within the flare and thereby permit the use of fairings to be used on the launcher and aerodynamic nose cones to be used on the warheads, as well as the use of standardized 70 mm packaging and logistics.

It would be a further advancement in the art if such an improved parachute deployment system included means to ensure that the flare ignition system is fired regardless of the velocity at which the main parachute is deployed.

Such a parachute deployment system is disclosed and claimed herein.

BRIEF SUMMARY AND OBJECTS OF THE INVENTION

The present invention is directed to a novel parachute deployment system for use with a flare warhead which is propelled by a rocket motor.

The parachute deployment system of the present invention utilizes a compact two-stage parachute system. The parachute system includes a drogue parachute housed within a drogue parachute pack and a main parachute housed within a main parachute pack. The two parachute packs are positioned in a detached, side-by-side relationship.

By incorporating this two-stage parachute system into a flare warhead, the length of the warhead is significantly reduced. Also, due to the novel way in which the parachute pack is incorporated into the warhead, performance of the warhead is substantially enhanced.

In accordance with the teachings of the present invention, the parachute packs are positioned within the warhead in a side-by-side, detached relationship with respect to each other. Advantageously, an extraction line connects the drogue parachute pack to the motor adapter. In one embodiment of the inventions, a pusher plate is also employed between the separation charge and the parachute packs and is attached to the extraction line.

The parachute packs are positioned within the warhead and are connected to each other only by means of sequencing lines which control the sequence in which the parachute packs are extracted from the warhead. Importantly, the parachute packs are extracted from the warhead one at a time.

In a preferred embodiment, the sequencing lines are configured such that upon firing of the separation charge and separation of the rocket motor from the warhead, the drogue parachute pack is initially extracted, followed by the extraction of the main parachute pack. Seriatim extraction of the parachute packs requires a lesser force than simultaneous extraction, as simultaneous extraction results in a substantial vacuum being generated within the warhead which must be overcome in order for extraction to be achieved.

After the parachute packs are extracted from the warhead, the extraction line becomes taut. The resulting force tending to continue to separate the rocket motor from the warhead is sufficient to break cotton ties which hold the drogue parachute within its pack. After these cotton ties break, the drogue parachute is pulled from its pack and inflates.

Following deployment of the drogue parachute, the drogue parachute cover acts as a deflector, preventing the rocket motor from colliding into the warhead. In embodiments employing a pusher plate, the pusher plate acts in combination with the drogue parachute cover as a deflector. Utilizing the drogue parachute pack as a deflector, either with or without the pusher plate, results in improved performance over that achieved by prior-art configurations.

As the drogue parachute deploys, it triggers a time-delayed line cutter which is attached to one of the sequencing lines. The time delay provided by the line cutter controls how long the drogue parachute is deployed. Upon expiration of the time delay within the line cutter, the line cutter severs the sequencing line to which it is attached.

Upon actuation of the line cutter, the load imposed by the drogue parachute is then transferred to the main parachute cover. Cotton ties holding the main parachute within the main parachute cover immediately break under the force of the load imposed by the drogue parachute. This detaches the drogue parachute from the warhead and permits the main parachute to deploy.

In one embodiment of the invention, an ignition lanyard is attached to the bridle of the main parachute. Because of the novel configuration of the parachute deployment system of the present invention, all forces acting on the warhead during deployment of the parachute system are transmitted through the main parachute bridle. With the ignition lanyard attached to the main bridle, multiple redundancies are built into the flare ignition system.

The parachute deployment system of the present invention is designed to successfully deploy over a wide range of velocities, such as is required when using a variable range fuse. Thus, depending on the velocity at which parachute deployment is commenced, the flare ignition system may be triggered at any time commencing with the separation of the rocket motor from the warhead to the deployment of the main parachute.

Thus, it is an object of the present invention to provide a parachute deployment system which incorporates an improved rocket motor deflector to thereby ensure that the rocket motor will not collide with the flare following its separation from the flare.

It is a further object of the present invention to provide such a parachute deployment system which enables the overall length of the warhead to be reduced without reducing the amount of illuminant included within the flare and thereby enable aerodynamic fairings and nose cones to be used on the warheads as well as standardized 70 mm packaging and logistics.

It is an additional object of the present invention to provide an improved parachute deployment system including means to ensure that the flare ignition system is fired regardless of the velocity at which the main parachute is deployed.

These and other objects and advantages of the present invention will become more fully apparent by examination of the following description of the preferred embodiments and the accompanying drawings.

BRIEF DESCRIPTION OF THE DRAWINGS

In order that the manner in which the above-recited and other advantages and objects of the invention are obtained, a more particular description of the invention briefly described above will be rendered by reference to the appended drawings. Understanding that these drawings only provide data concerning typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 5:
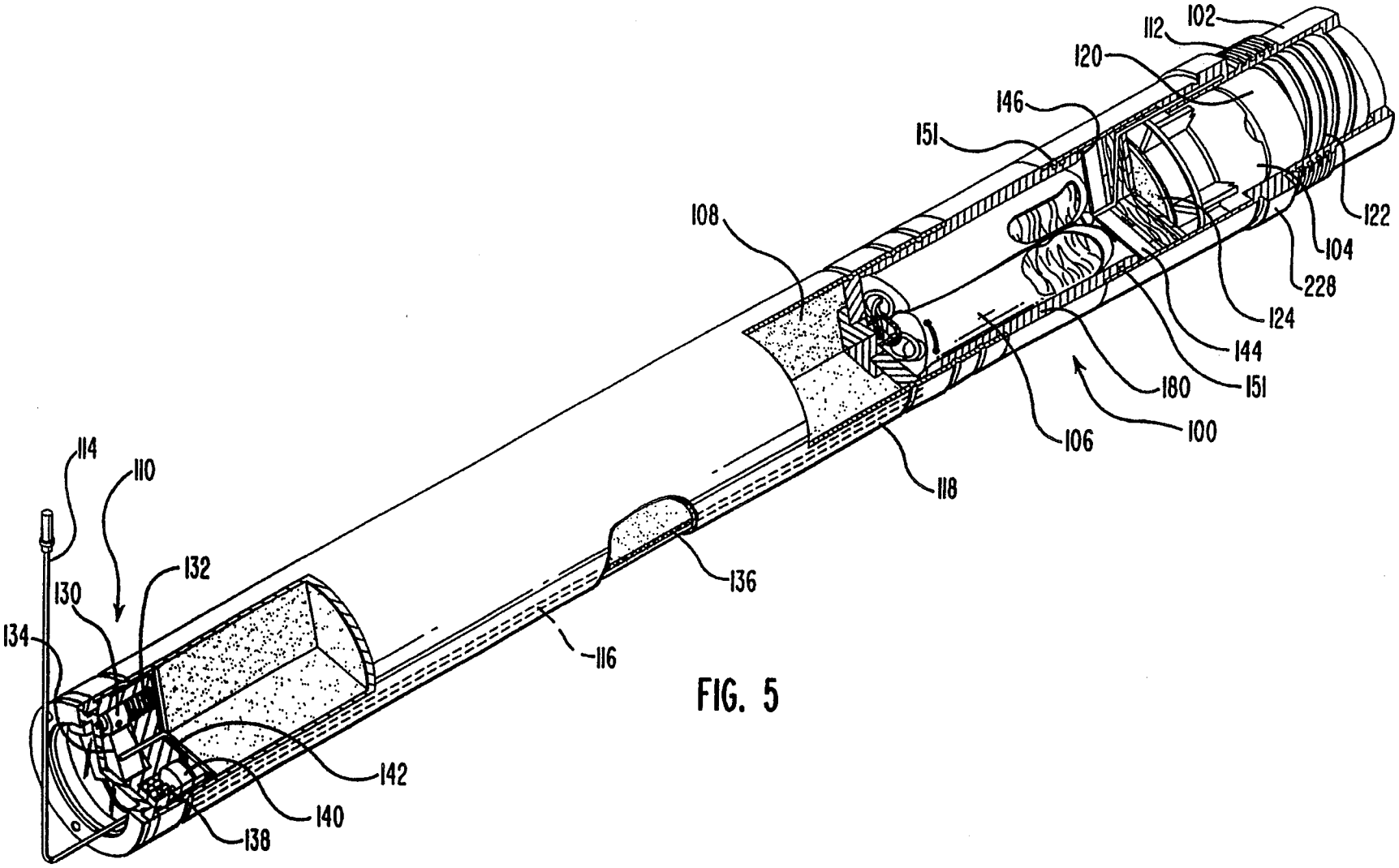
FIG. 5 is a perspective view of one embodiment of the parachute deployment system of the present invention, with portions of the flare canister cut away to more particularly illustrate the invention.

Reference is now made to the figures wherein like parts are referred to by like numerals throughout. With particular reference to FIG. 5, one embodiment of a flare warhead equipped with a parachute deployment system according to the present invention is generally designated at 100. The flare warhead 100 includes a motor adapter 102, a fuse 104, a two-stage parachute system 106, flare illuminant 108 and an illuminant ignition system 110.

Motor adapter 102 is that conventionally known for use with military warheads, and will generally include threads 112 which are used to threadably connect the warhead 100 to a rocket motor.

Fuse 104 may be a conventionally known remote-set fuse and fits within the bore of the motor adapter 102. A coaxial umbilical cable 114 permits the fuse to be set from a remote location, such as from the cockpit of a helicopter or airplane. The umbilical cable 114 mates with the launching aircraft control system and is electrically connected to the fuse 104 via a flat cable passing through or under a raceway 116 located between the illuminant 108 and the flare canister 118. Holes (not shown) are drilled through the top and bottom of the ignition system 110 to allow passage of the cable 114.

Of course, it will be appreciated that any of a variety of fuses may be employed, including both fixed and variable range fuses. Indeed, the parachute deployment system of the present invention is ideally suited for use with variable range fuses in that it may successfully deploy over a range of velocities from about 250 m/s to about 1,000 m/s. These velocities generally correspond to a standoff range from about 1,000 to about 15,000 meters.

In some embodiments, it may be preferred to include a threaded plug (not shown) in the aft end of the motor adapter 102. Such a plug provides additional access to install and connect the fuse. Also, the plug provides access to permit the fuse to be manually removed in the event emergency disarming of the flare is necessary.

As with the M-257 Standard Flare explained above and illustrated in FIGS. 1–4, fuse 104 is armed upon initial acceleration of the rocket motor. Fuse 104 includes a slider 120 which is of sufficient mass that it compresses a spring 122 upon acceleration of the rocket motor. Upon burn-out of the rocket motor, the slider 120 is forced back to the position illustrated in FIG. 5 by the extension force of the spring 122.

At the end of its stroke, the slider 120 releases a firing pin which strikes a priming cap (not shown) and causes it to fire. The priming cap is positioned contiguous a pyrotechnic delay column (not shown) such that firing of the priming cap ignites the delay column. The delay column burns for a predetermined period of time, generally about nine seconds, while the flare is coasting through the air. As the delay column burns out, it ignites a separation charge 124.

A variable range fuse accomplishes through electrical means the same result as does the standard set-back fuse 104. Thus, in embodiments of the present invention which employ a variable range fuse, instead of utilizing a pyrotechnic delay column to control the amount of coast time of the flare, an electronic delay sets the coast time. The desired coast time is a function of how far the flare should travel before deployment of the drogue parachute. At the desired time, the variable range fuse causes the separation charge to ignite.

Figure 1:
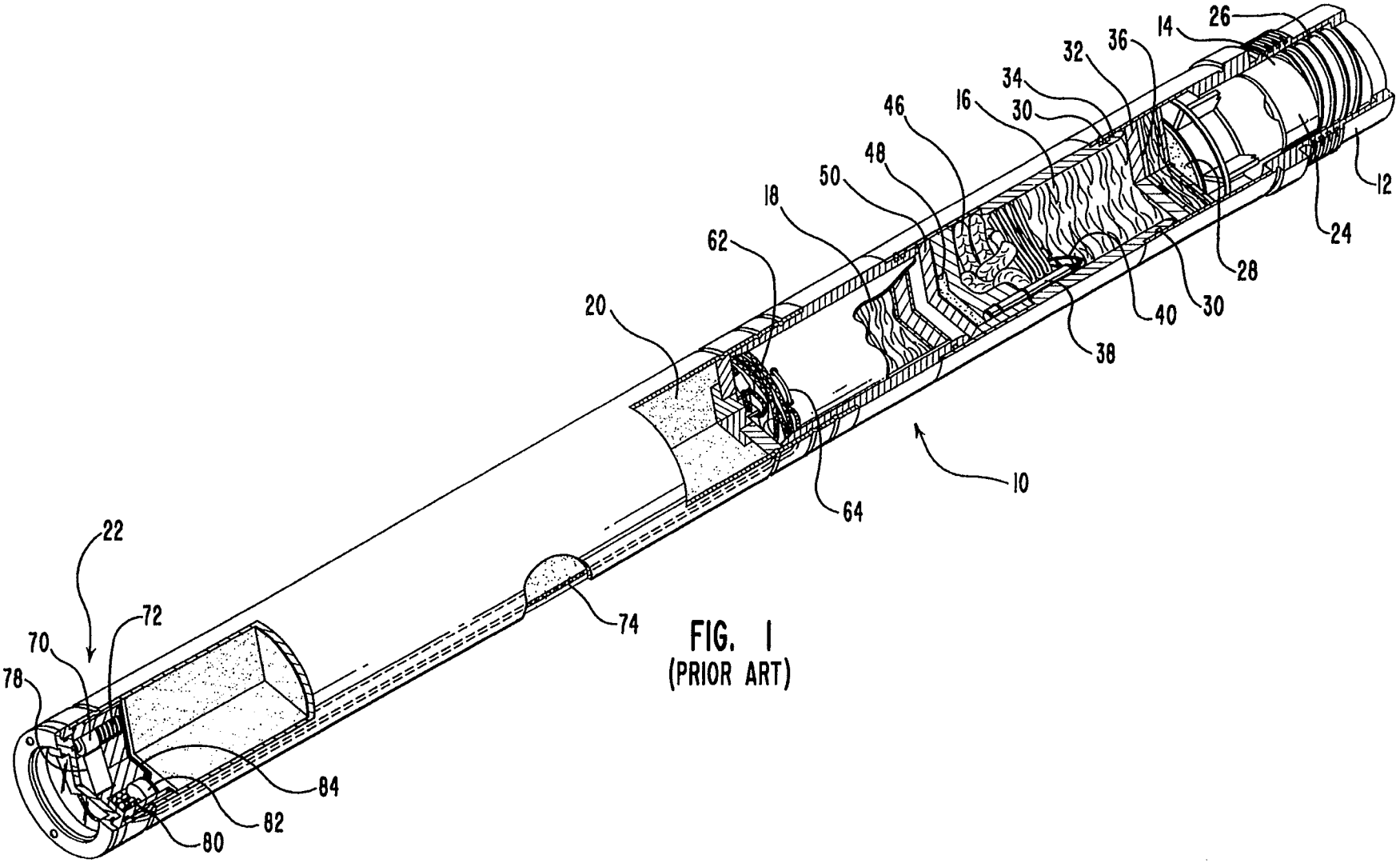
FIG. 1 (PRIOR ART)
FIG. 1 is a perspective view of a prior-art M-257 warhead, with portions cut away to more particularly illustrate some of the features of its parachute deployment system.
Figure 2:
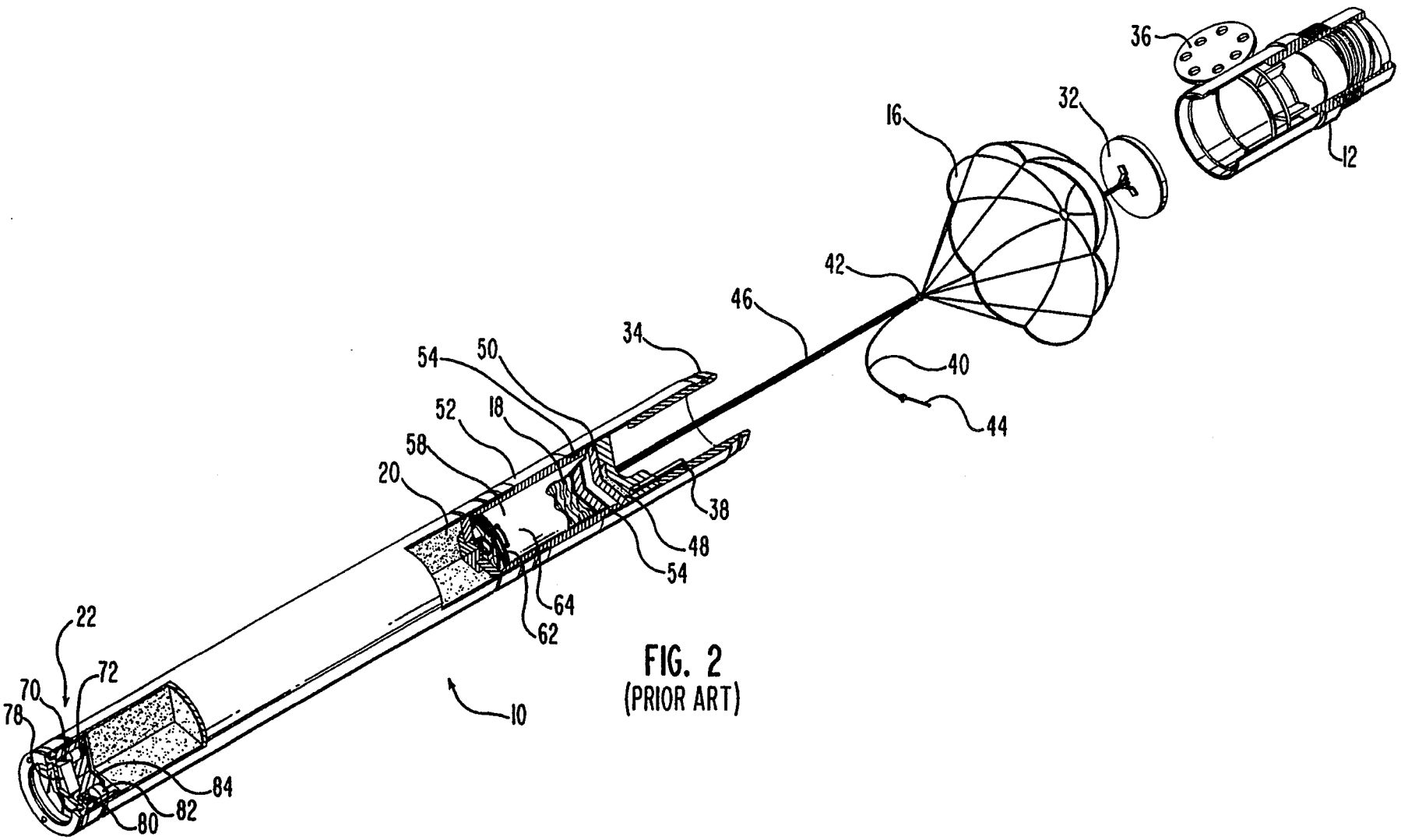
FIG. 2 (PRIOR ART)
FIG. 2 is a perspective view of the warhead of FIG. 1 with the drogue parachute deployed and portions of the flare canister cut away.
Figure 3:
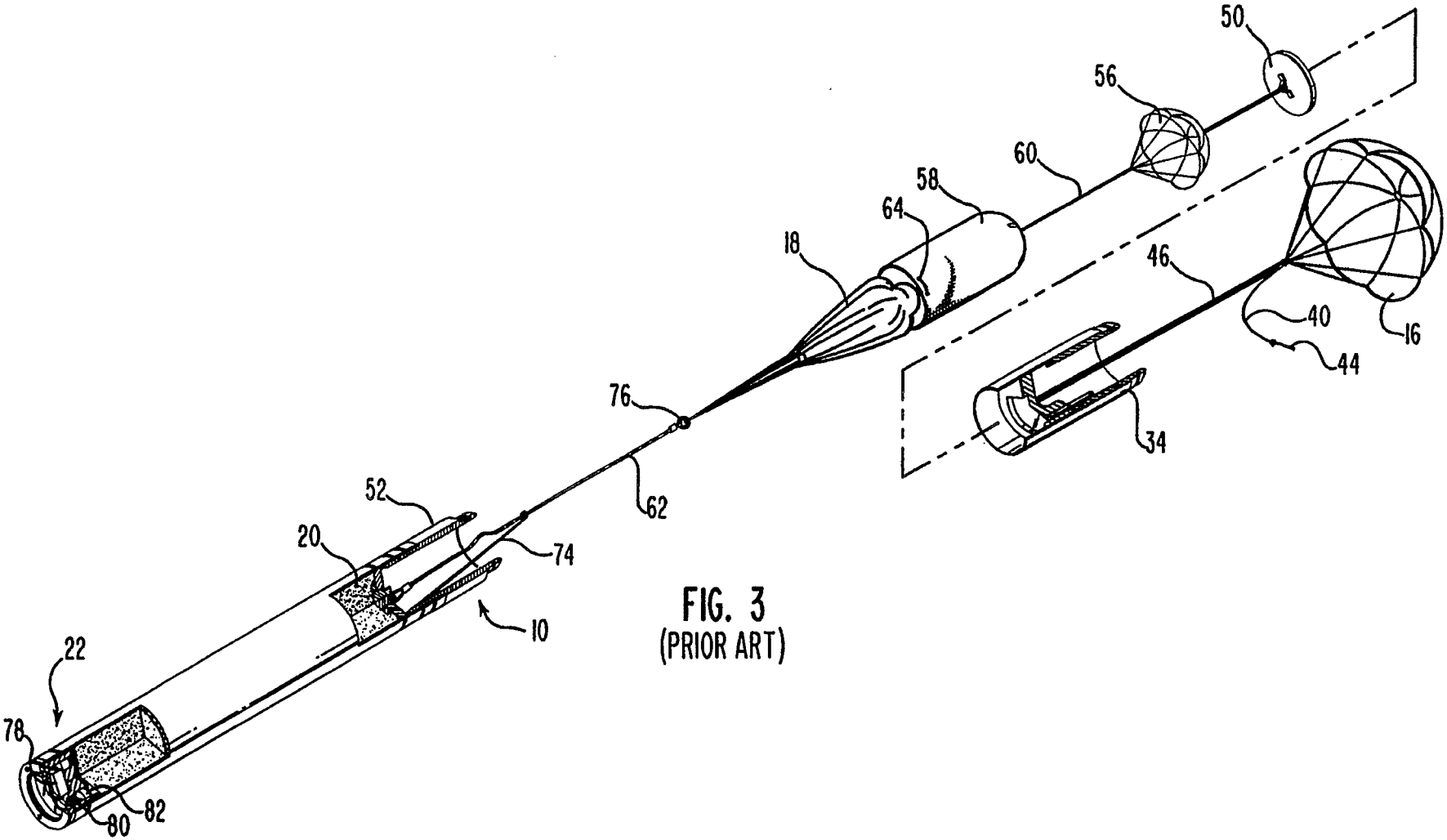
FIG. 3 (PRIOR ART)
FIG. 3 is a perspective view of the warhead of FIG. 1 with the pilot parachute deployed and portions of the flare canister cut away.
Figure 4:
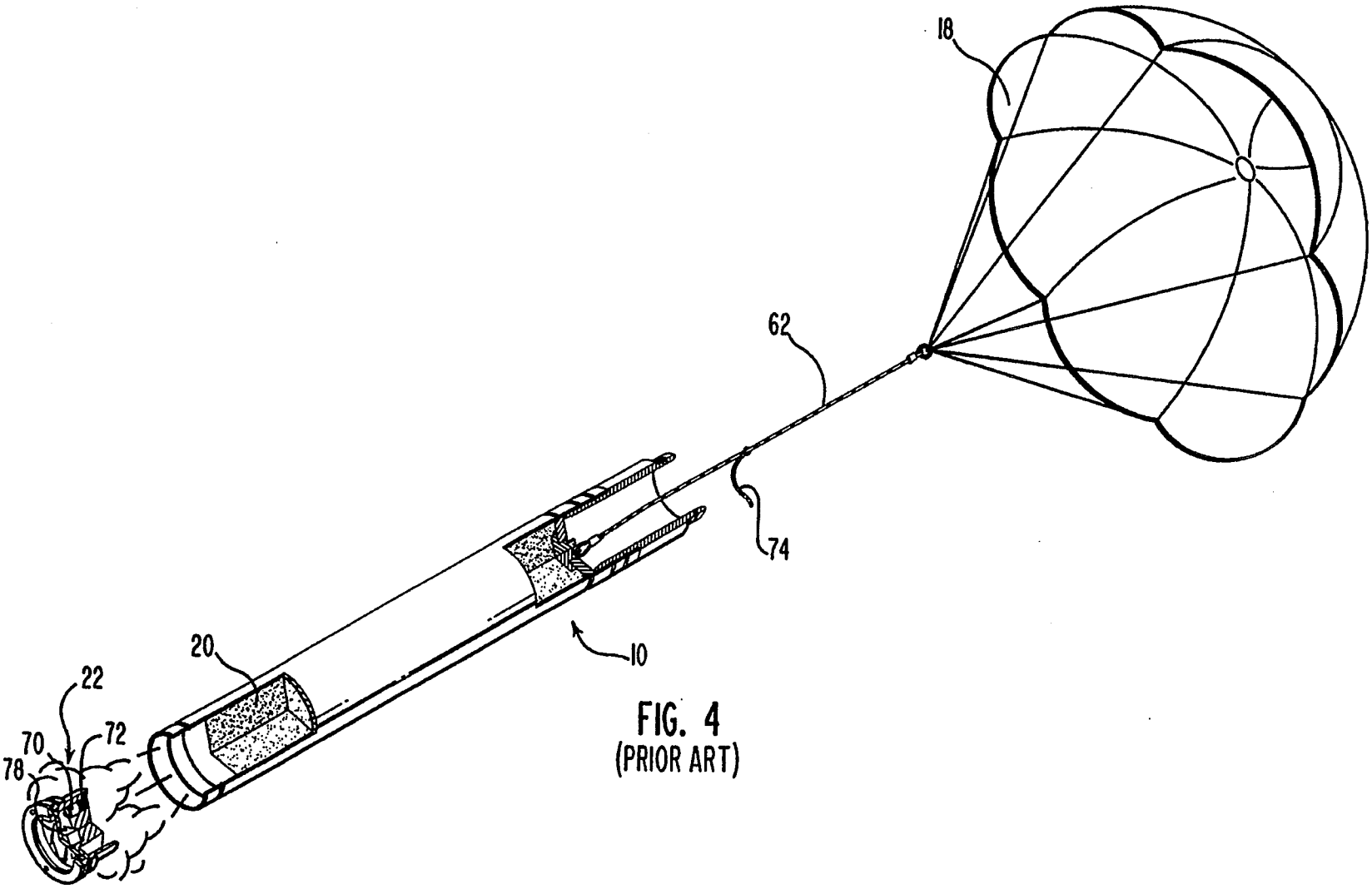
FIG. 4 (PRIOR ART)
FIG. 4 is a perspective view of the warhead of FIG. 1 with the main parachute deployed and portions of the flare canister cut away.

The flare warhead 110 may also include a standard ignition system 110, such as that described in connection with the M-257 illustrated in FIG. 1. The ignition system 110 includes a "zig-zag" safety block 130 which compresses a spring 132 upon initial acceleration of the rocket motor, thereby arming the ignition system 110. With the zig-zag safety block 130 retracted, a slider 134 may be pulled across its track by an ignition lanyard 136. The ignition lanyard is positioned in raceway 116 and is connected to the main parachute bridle, as will be explained below in further detail.

When the ignition lanyard 136 is pulled with a force sufficient to pull the slider 134 across its path, the slider 134 retracts and releases a spring-loaded hammer which fires a priming cap into a $BKNO_3$ pellet basket 138. As an alternative to $BKNO_3$ pellets, magnesium/teflon pellets may also be used. As explained previously in connection with the M-257, the firing of the $BKNO_3$ pellet basket 138 fires a propellant wafer 142. The firing of the propellant wafer 142 creates sufficient heat that the illuminant 108 is ignited. Also, the firing of the propellant wafer 142 creates sufficient gas pressure that the ignition system 110 is blown off the end of the flare, thereby permitting the light generated by the burning illuminant 108 to shine out of the canister 118 and illuminate the area below the flare.

Figure 6:
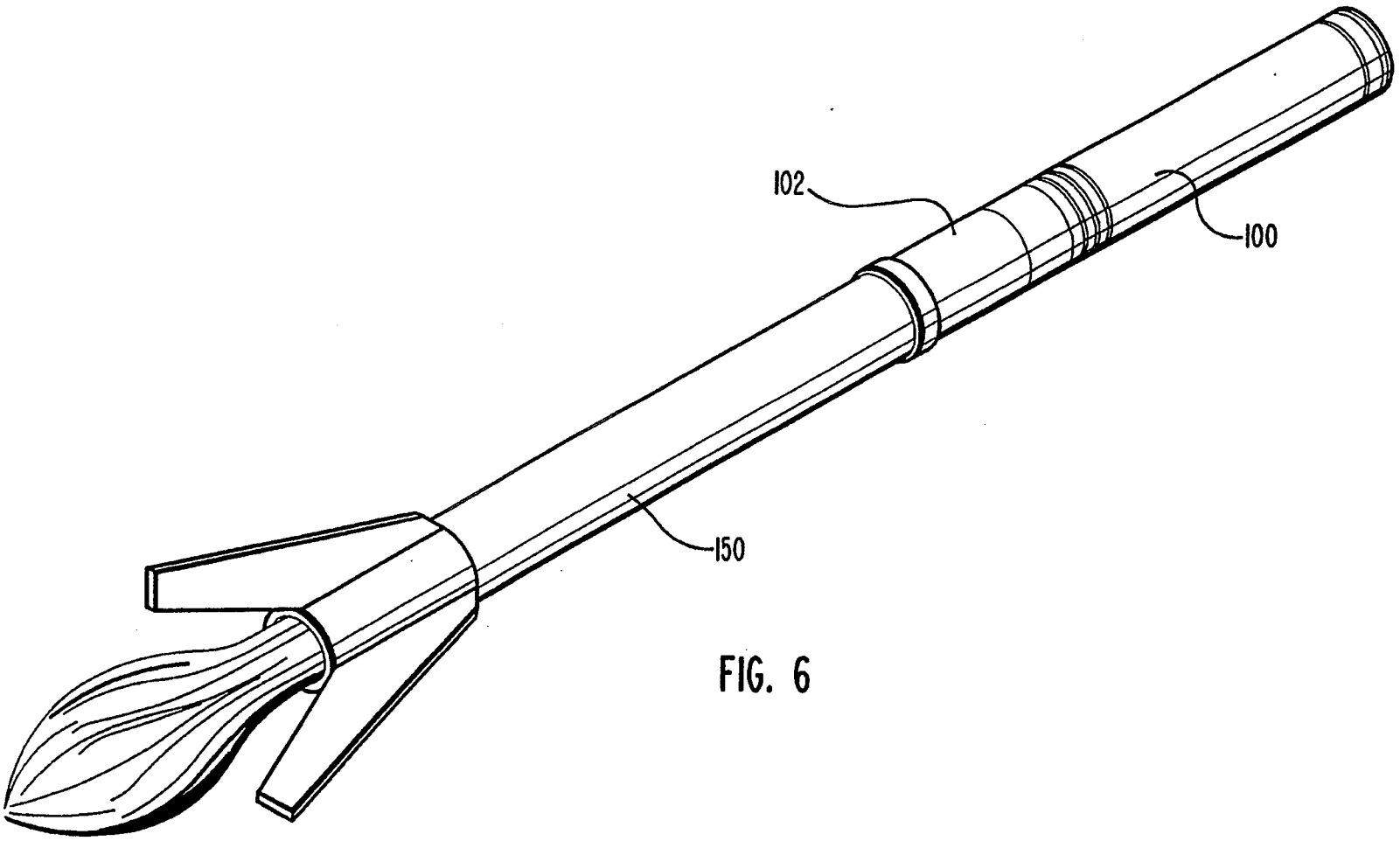
FIG. 6 is a perspective view of a flare warhead including the parachute deployment system of FIG. 5 and mounted on a typical rocket motor, showing the warhead in the initial moments of launch.

As illustrated in FIG. 6, the flare warhead 100 is initially connected to a rocket motor 150 which, when fired, accelerates the warhead to a maximum velocity. The separation charge is fired a predetermined period of time following burnout of the rocket motor, as determined by the particular fuse employed. Upon firing of the separation charge, the gas pressure within the fuse cavity causes a pusher plate 144 (FIG. 5) to bear against the aft end 146 of the parachute housing 180. The loads generated by the gas pressure result in the shearing of shear pins 151.

The size and number of shear pins 151 employed is a function of the gas pressure generated upon the firing of the separation charge 124, and may be readily determined by one of skill in the art. In the illustrated embodiment, the separation charge 124 comprises a 5.1 to 5.5 gram charge of M-9 propellant which is sufficient to shear up to twelve 0.125 inch diameter aluminum shear pins 151.

In contrast to the two pinned joints required on the prior-art M-257 warhead, the warhead of the present invention has only one pinned joint. Consequently, the complete rocket round is more stable in flight than the M-257.

Figure 7:
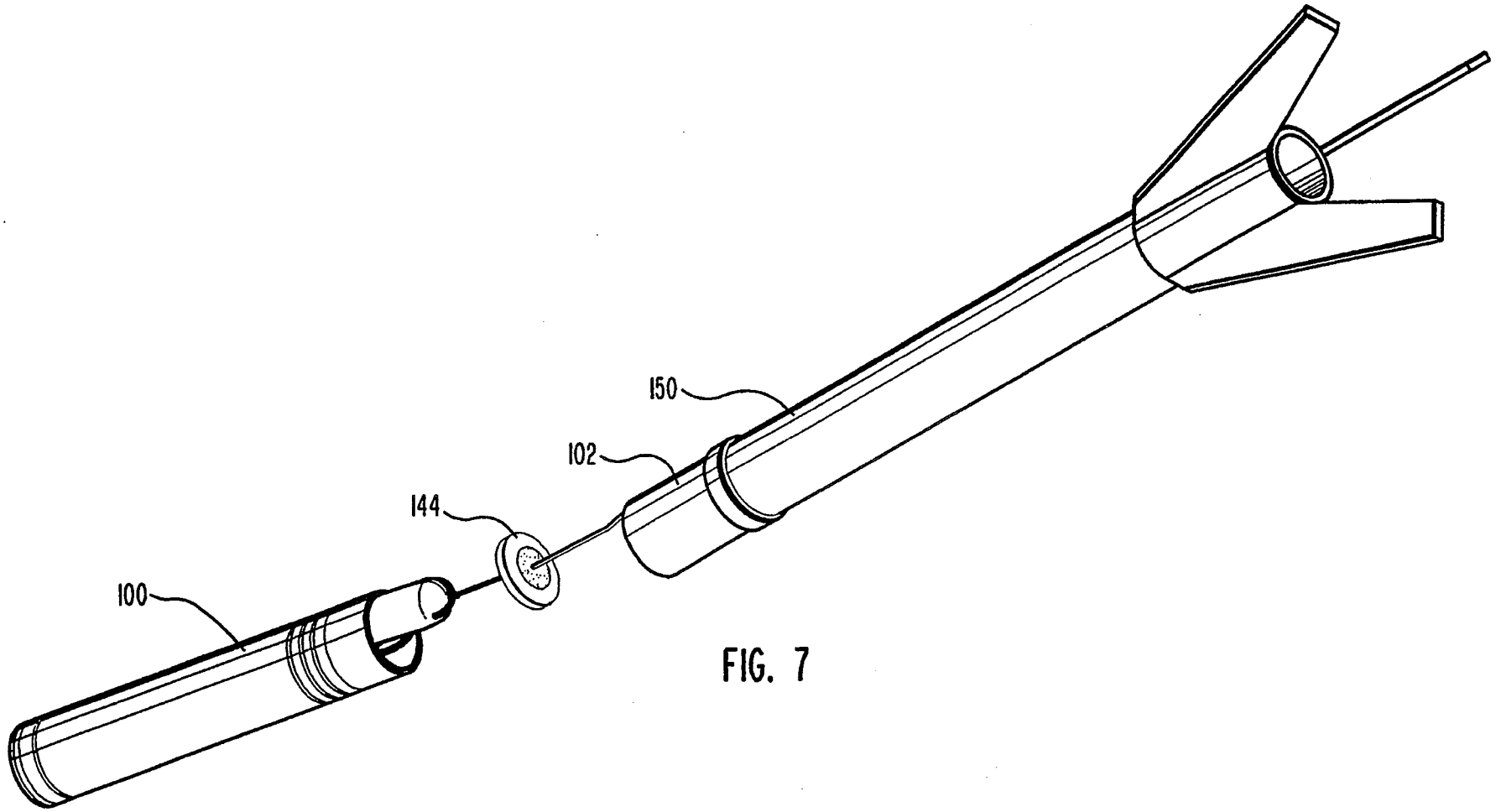
FIG. 7 is a perspective view of the flare warhead of FIG. 6 following the firing of the separation charge.
Figure 8:
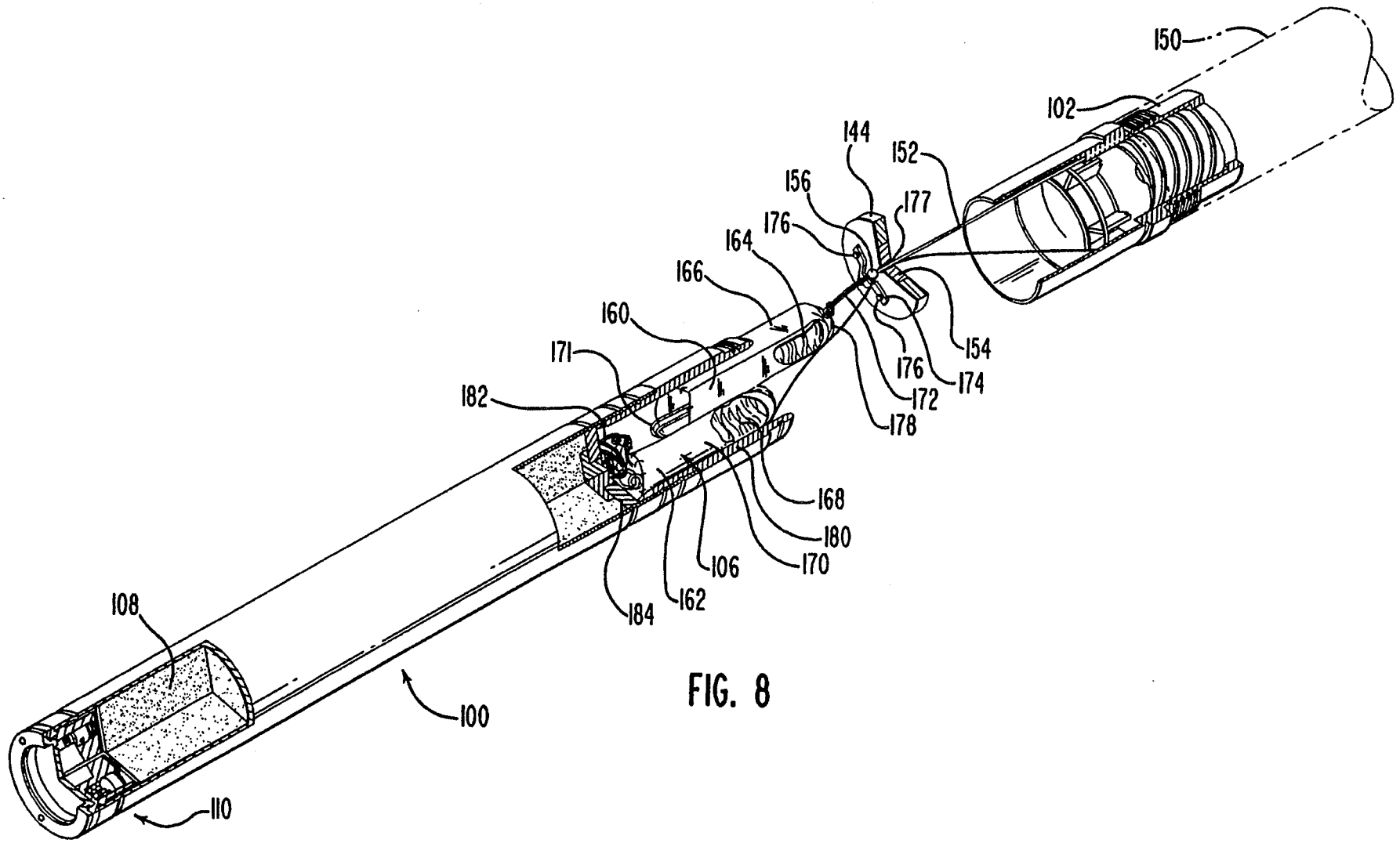
FIG. 8 is a perspective view of the flare warhead of FIG. 6 as the parachute packs are extracted, with portions cut away to more clearly illustrate the invention.

As the shear pins 151 break, the flare 100 separates from the rocket motor 150, as illustrated in FIG. 7. With reference now to FIG. 8, it can be seen that an extraction line 152 connects the pusher plate 144 to the motor adapter 102. The extraction line 152 is preferably a metal cable which is attached to the motor adapter 102 by a threaded fitting. The extraction line 152 is attached to the pusher plate by passing the line through a hole in the pusher plate 144 and sealing the hole with a quick-curing polyurethane adhesive 154. Alternatively, any polymeric sealant may be employed, including epoxy and polyester sealants.

The extraction line 152 is terminated at the head end of the pusher plate 144 with a metal ball 156 which aids in equilibrating the distribution of forces from the extraction line 152 on the pusher plate 144. A pair of wires (not shown) are also passed through the hole in the pusher plate 144 before it is sealed to connect the fuse stake-pins and the contacts to the flat cable which passes along the raceway 116 from the umbilical cable 114.

The hole within the pusher plate 144 must be sealed to prevent the hole from acting as a nozzle. If the hole is not entirely sealed, there exists the possibility that, upon firing of the separation charge 124, high-temperature gasses will pass through the hole and be concentrated on the parachute packs or the cables positioned adjacent the pusher plate 144.

With continued reference to FIG. 8, the two-stage parachute system 106 includes a drogue parachute pack 160 and a main parachute pack 162. The drogue parachute pack 160 includes a drogue parachute 164 which is housed within a drogue chute cover 166. Likewise, the main parachute pack 162 includes a main parachute 168 which is housed within a main chute cover 170. The drogue chute cover 166 and the main chute cover 170 are preferably made of Kevlar® cloth with an aluminized coating, thereby permitting them to resist any heat which may leak past the pusher plate 144. One of skill in the art will, of course, appreciate that a variety of fabrics may be utilized to construct the parachute covers. A main drogue line 171 serves to connect the drogue parachute pack 160 to the main parachute pack 162, as is explained below in greater detail.

The preferred two-stage parachute system 106 is a modified version of a parachute system designed by Pioneer Aerospace of South Windsor, Conn. The two-stage parachute system utilized with the present invention permits the chute packs to be extracted from the parachute housing 180 one at a time. Seriatim extraction of the chute packs prevents a substantial vacuum from being generated within the warhead and thereby requires a lesser force to extract the parachute packs than does simultaneous extraction.

A drogue extraction line 172 attaches the drogue parachute pack 160 to the pusher plate 144. In a preferred embodiment, the drogue extraction line 172 is a Kevlar® rope. The drogue extraction line 172 is attached to the pusher plate 144 by cow hitching it to a mounting plate-174 which is mounted onto the pusher plate 144. The mounting plate 174 is preferably mounted to the pusher plate 144 by means of two rivets 176 and is positioned such that the drogue extraction line 172 and the extraction line 152 are substantially collinear when taut.

Although it is presently preferred to configure the pusher plate 144 with the extraction line 152 and the drogue extraction line 172 each attached to the center of the pusher plate 144, these lines may be mounted in other locations on the pusher plate 144 so long as they are mounted on substantially the same location on the pusher plate 144, thereby ensuring they remain in a collinear relationship. If the drogue extraction line 172 is not collinear with the extraction line 152, the extraction line 152 will bend at the aft end 177 of the pusher plate 144 when the line is loaded. Consequently, stress risers at that point in the extraction line 152 may be sufficient to sever the line and cause the attempted extraction of the drogue parachute pack 160 to fail.

With continued reference to FIG. 8, the drogue extraction line 172 is attached to the drogue parachute pack 160 by cow hitching it to a drogue cover strap 178. The drogue parachute pack 160 and the main parachute pack 162 are positioned within the parachute housing 180 in a detached relationship. Hence, upon separation of the motor adapter 102 from the warhead, the drogue parachute pack 160 is initially extracted from the parachute housing 180 when the extraction line 152 and the drogue extraction line 172 become fully extended.

Thus, in this embodiment of the invention, the rocket motor 150, motor adapter 102 and pusher plate 144 act unitedly as an extraction implement which is separated from the warhead to promote deployment of the parachute system. In other embodiments, it may be desirable to utilize other extraction implements such as a sole pusher plate.

The main drogue line 171 extends out of the head end of the drogue parachute pack 160 and into the aft end of the main parachute pack 162. Thus, upon extraction of the drogue parachute pack 160 from the parachute housing 180, the main drogue line 171 causes the main parachute pack 162 to also be extracted. The main parachute pack 162 is connected to the flare via a main parachute line 182 which is attached to a bulkhead 184 at the aft end of the illuminant 108. Parachute line 182 is preferably a 4,000-lb Kevlar® line, although a steel line may also be used. At this point in the deployment process, both parachute packs are extracted from the parachute housing 180, but no parachutes have yet deployed (compare FIGS. 8 and 9).

Figure 9:
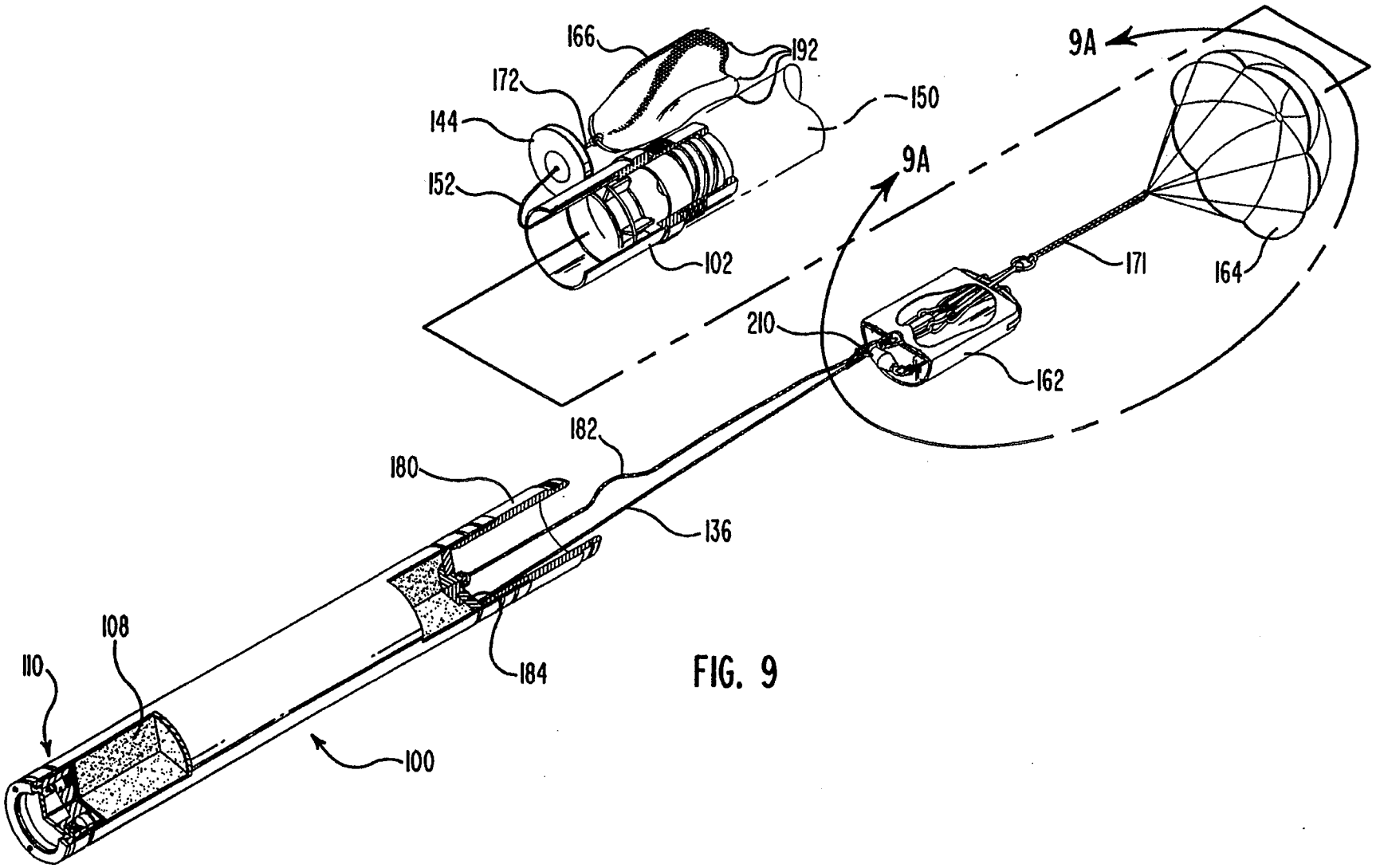
FIG. 9 is a perspective view of the flare warhead of FIG. 6 immediately following drogue deployment, with portions cut away to more clearly illustrate the invention.

As best illustrated in FIG. 9, the ignition lanyard 136 is attached to the main parachute line 182 by crimping it around the main bridle 210. The length of the ignition lanyard 136 is measured to be shorter than the length of the main chute line 182. Thus, as the parachute packs are extracted and the lines extending between the motor adapter 102 and the flare 100 become taut, the ignition lanyard 136 will bear the load until it is pulled.

By so configuring the ignition lanyard 136, if the separation force induced by the firing of the separation charge 124, as supplemented by the force of air resistance on the motor adapter 102, the pusher plate 144 and the parachute packs, is sufficient, the ignition lanyard 136 may be pulled hard enough to trigger the ignition system 110 before any parachutes deploy.

As the extraction line 152, the drogue extraction line 172, the main parachute line 182 and the ignition lanyard 136 become fully extended, the resulting jerk pulls on the ignition lanyard 136 and causes cotton ties 192 on the head end of the drogue chute cover 166 to break. As the cotton ties 192 break, the drogue chute cover 166 is pulled off the drogue parachute 164, thereby permitting the drogue parachute 164 to inflate as illustrated in FIG. 9.

As the drogue parachute 164 is inflated, it exerts a substantial jerk on all the lines connecting the drogue parachute 164 to the bulkhead 184. Thus, if the flare ignition system 110 has not yet been triggered, the force on the ignition lanyard 136 resulting from the deployment of the drogue parachute 164 may be sufficient to trigger the ignition system 110. As soon as the ignition lanyard 136 is pulled with sufficient force to trigger the flare ignition system 110, the main chute line 182 then supports the entire load imposed by the drogue parachute 164.

As soon as the drogue chute cover 166 is pulled off the drogue parachute 164, both the drogue chute cover 166 and the pusher plate 144 are subjected to the substantial forces of wind resistance imposed by the atmosphere. The drogue chute cover 166 and the pusher plate 144 generally are forced alongside the motor adapter 102, as illustrated in FIG. 9, where they act as a motor deflector. The aerodynamic forces acting on the drogue chute cover 166 and the motor adapter 102 give rise to radial forces which act on the rocket motor and cause the rocket motor to deviate from the path being traveled by the flare 100, thereby preventing the rocket motor from colliding with the flare 100.

Figure 9A:
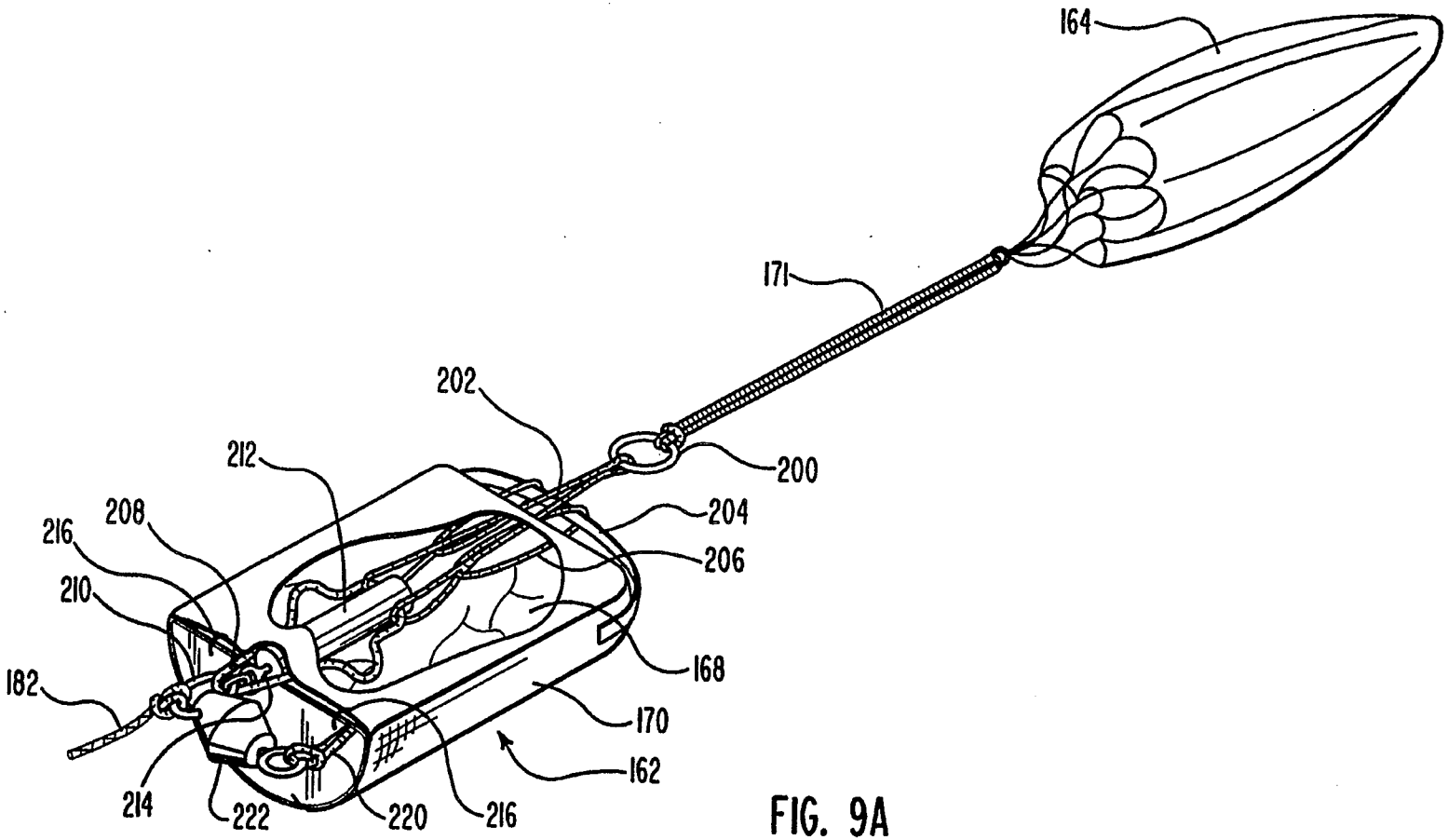
FIG. 9A is a perspective view taken along line 9A—9A of FIG. 9 immediately prior to the inflation of the drogue parachute, with portions cut away to more clearly illustrate the invention.

As illustrated in FIG. 9A, the drogue chute line 171 is attached to a drogue bridle 200 to which are attached two drogue loops 202. The drogue loops 202 also connect to secondary loops 206 which include within their loop the main cover strap 204. A Kevlar ® sequencing line 208 connects the drogue loops 202 to a main bridle 210. The main chute line 182 also is attached to the main bridle 210.

The sequencing line 208 passes through a line cutter 212, located within the main chute cover 170. The line cutter includes an internal timer and cutting mechanism which actuates to sever the sequencing line 208 a predetermined amount of time following the triggering of the line cutter 208. In the illustrated embodiment, the line cutter 208 provides an approximate four second delay. Of course, the line cutter 208 may be selected with such delay time as is appropriate for the particular application for which the parachute deployment system is to be used.

Figure 9B:
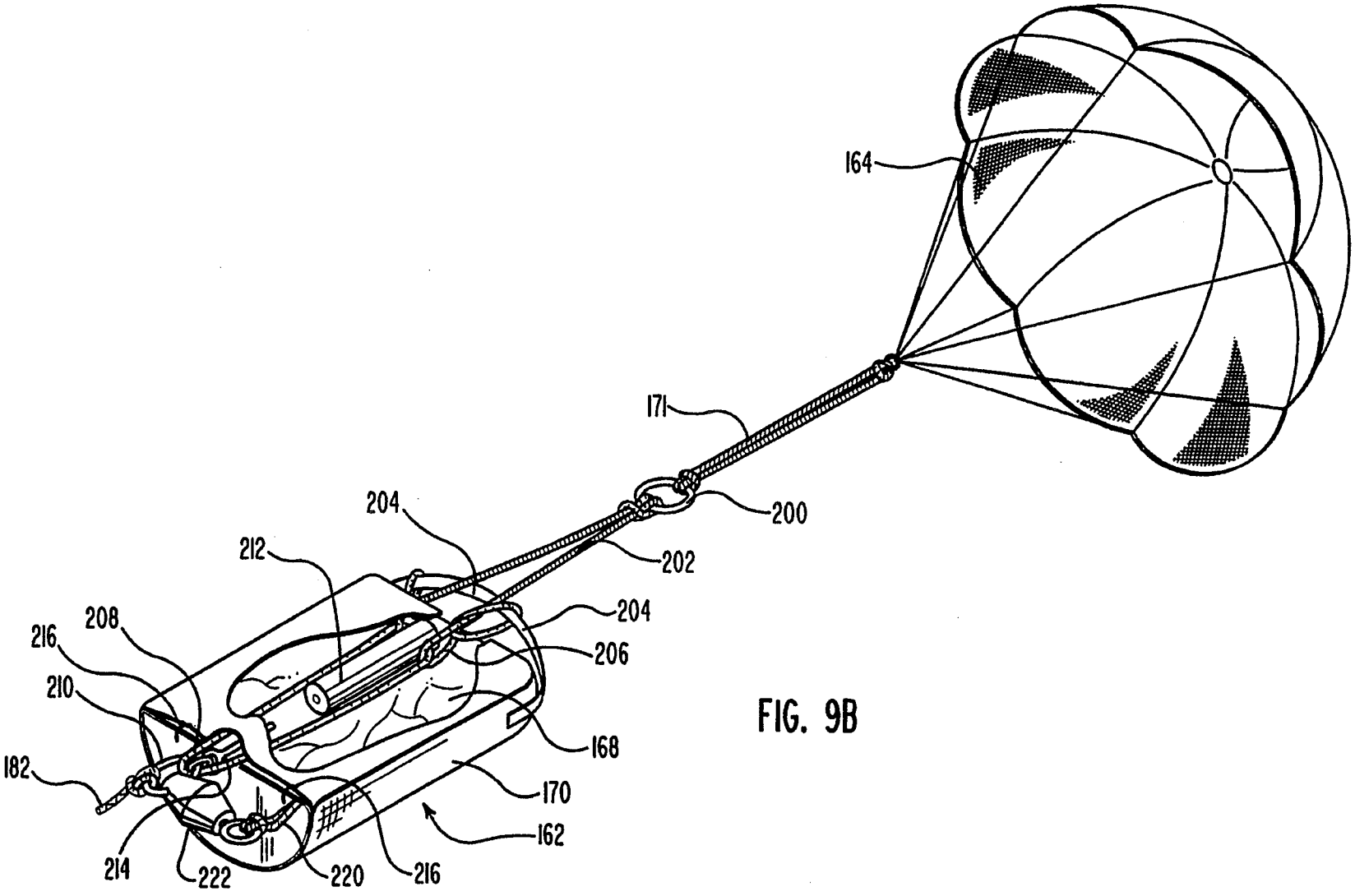
FIG. 9B is a perspective view of the components of the invention illustrated in FIG. 9A immediately following the inflation of the drogue parachute, with portions cut away to more clearly illustrate the invention.

The line cutter 212 is triggered by rapidly extracting a quick match or trigger wire 214 from the line cutter 212. To this end, the quick match or trigger wire 214 is connected to the main bridle 210 such that upon inflation of the drogue parachute 164, the sequencing line 208 becomes fully extended thereby rapidly separating the line cutter 212 and the quick match 214 (compare FIGS. 9A and 9B).

Figure 10:
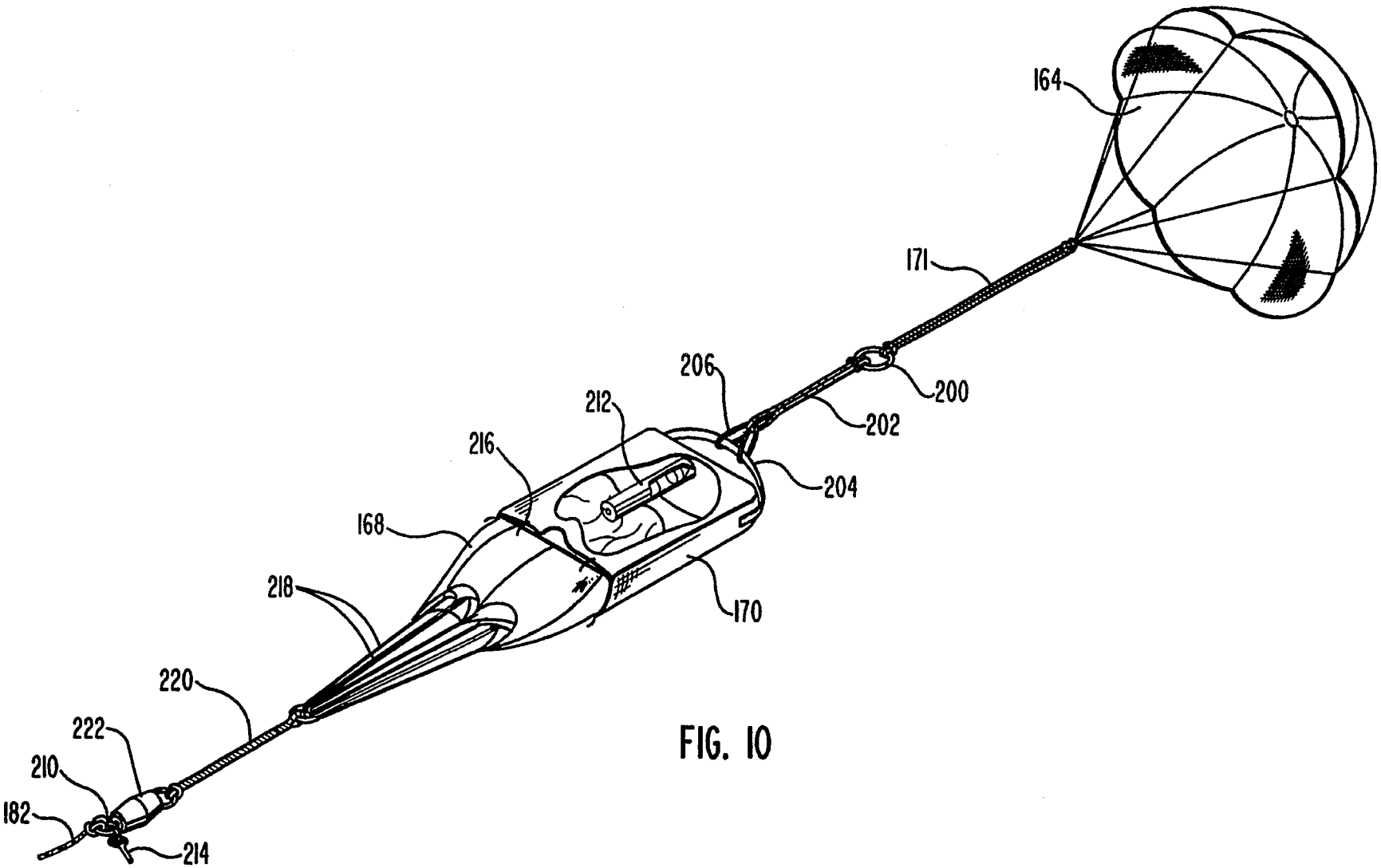
FIG. 10 is a perspective view of the components of the invention illustrated in FIG. 9A immediately following the firing of the line cutter, with portions cut away to more clearly illustrate the invention.

As viewed in FIG. 10, upon firing of the line cutter 212 and the consequent severing of the sequencing line 208, the drogue loops 202 are solely supported by the main cover strap 204. These loads are transferred to the main chute cover 170, causing the cotton ties 216 which hold the main chute cover 170 together to break. As the cotton ties 216 break, the main parachute 168 is stripped out of the main chute cover 170 and inflates.

Figure 11:
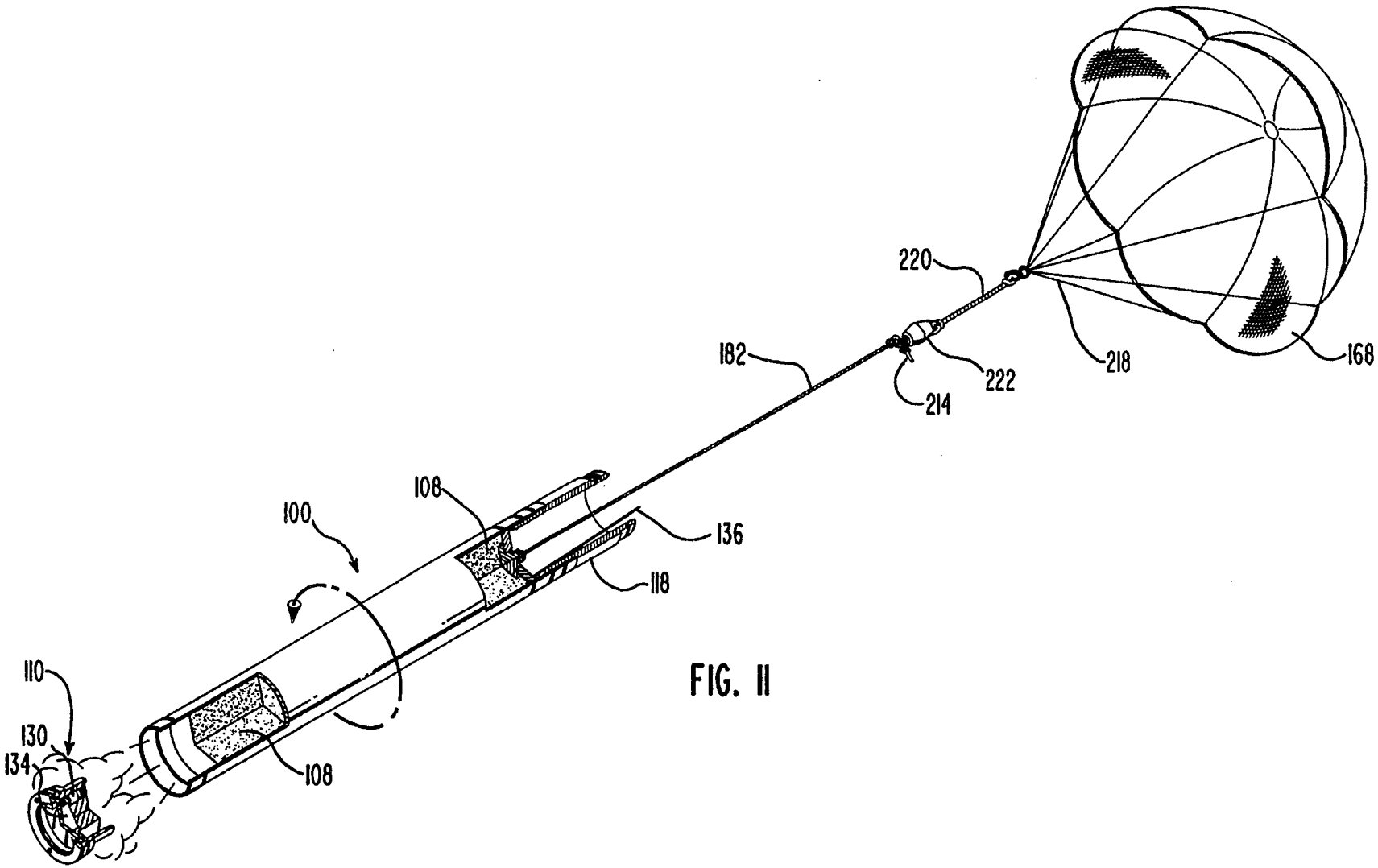
FIG. 11 is a perspective view of the flare warhead of FIG. 6 upon inflation of the main parachute, with portions cut away to more clearly illustrate the invention.

As illustrated in FIG. 11, the main parachute 168 is supported by a plurality of shroud lines 218 which are attached to a main line 220. In the illustrated embodiment, the main parachute 168 has a 52 inch diameter. Main line 220 is preferably made of high-strength Kevlar ® and is attached at its opposite end to a swivel 222. The swivel 222 must be capable of supporting at least 500 pounds, such as the X8R swivel made by the Sampo Division of Rome Industries of Barneveld, N.Y.

Upon inflation of the main parachute 168, the resulting jerk and tension in the main parachute line 182 is again transferred to the ignition lanyard 136. If the ignition lanyard 136 has not already been pulled with sufficient force to trigger the firing of the ignition system 110, the substantial force of deceleration imposed by the inflation of the main parachute 168 is generally sufficient to trigger the firing of the ignition system 110.

As explained previously, as the ignition system 110 is fired, the firing of the propellant wafer within the ignition system generates internal gas pressure which blows the ignition system off the head end of the flare 100 and ignites the illuminant 108.

To improve the aerodynamic performance of the warhead, most rocket motors include fins which impart substantial rotational velocities to the warhead. For the illustrated embodiment, these rotational velocities are approximately 22 rev/sec. The swivel 222 thus permits the flare 100 to continue to rotate while preventing the shroud lines 218 from twisting together and collapsing the main parachute 168.

Figure 12:
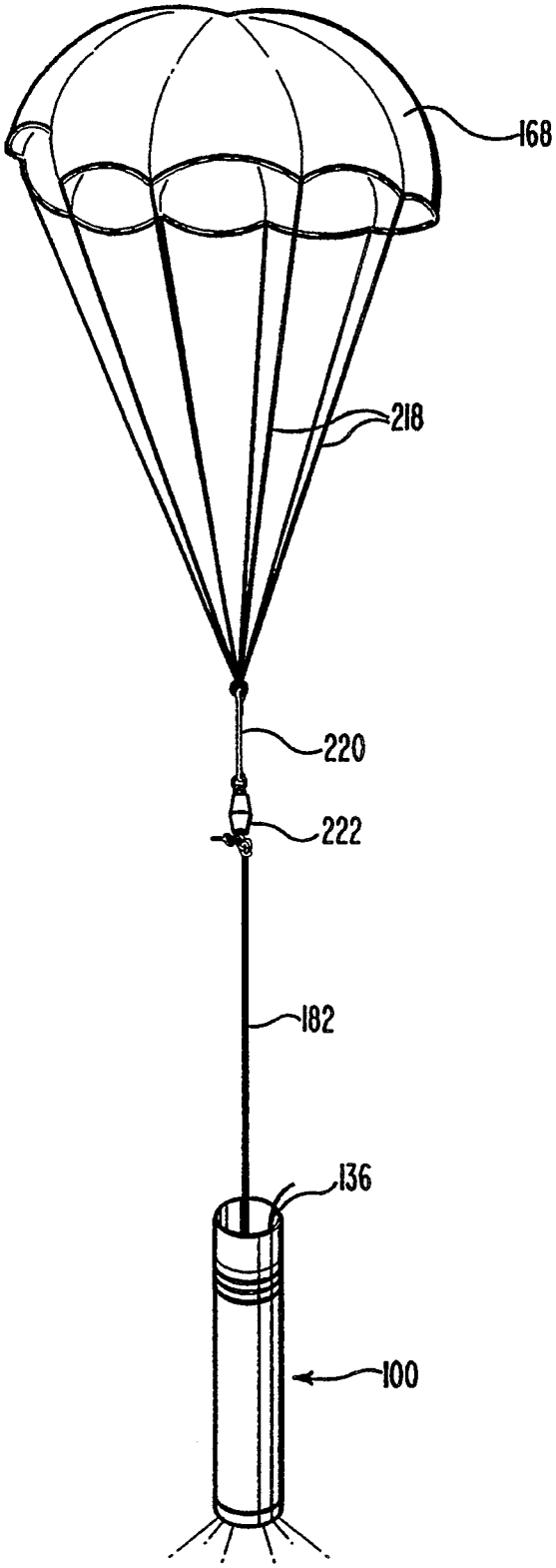
FIG. 12 is a perspective view of the flare warhead of FIG. 6 following deployment of the main parachute.

With the flare 100 ignited and the main parachute 168 deployed, the warhead gradually descends at a rate of about 12 to 15 ft/sec during the 120 second burn time of the illuminant 108, as illustrated in FIG. 12. Illuminant 108 may include any of a variety of burnable compositions known in the art, including those which generate visible or infrared light. One composition suitable for use as the illuminant is the Thiolite ® illuminant, manufactured by Thiokol Corporation. One of skill in the art will appreciate that compositions for generating smoke or other obscurants may readily be substituted for the illuminant.

The flare 100 of FIG. 5 is 26.87 inches long and has a diameter of 2.75 inches. The aft end borelet 228 acts as a bore rider in the launch tube and has a diameter of 2.79 inches. Thus, while preserving the same diametrical dimensions as the standard 70 mm warheads, the length of the flare is reduced to less than 27 inches.

Figure 13:
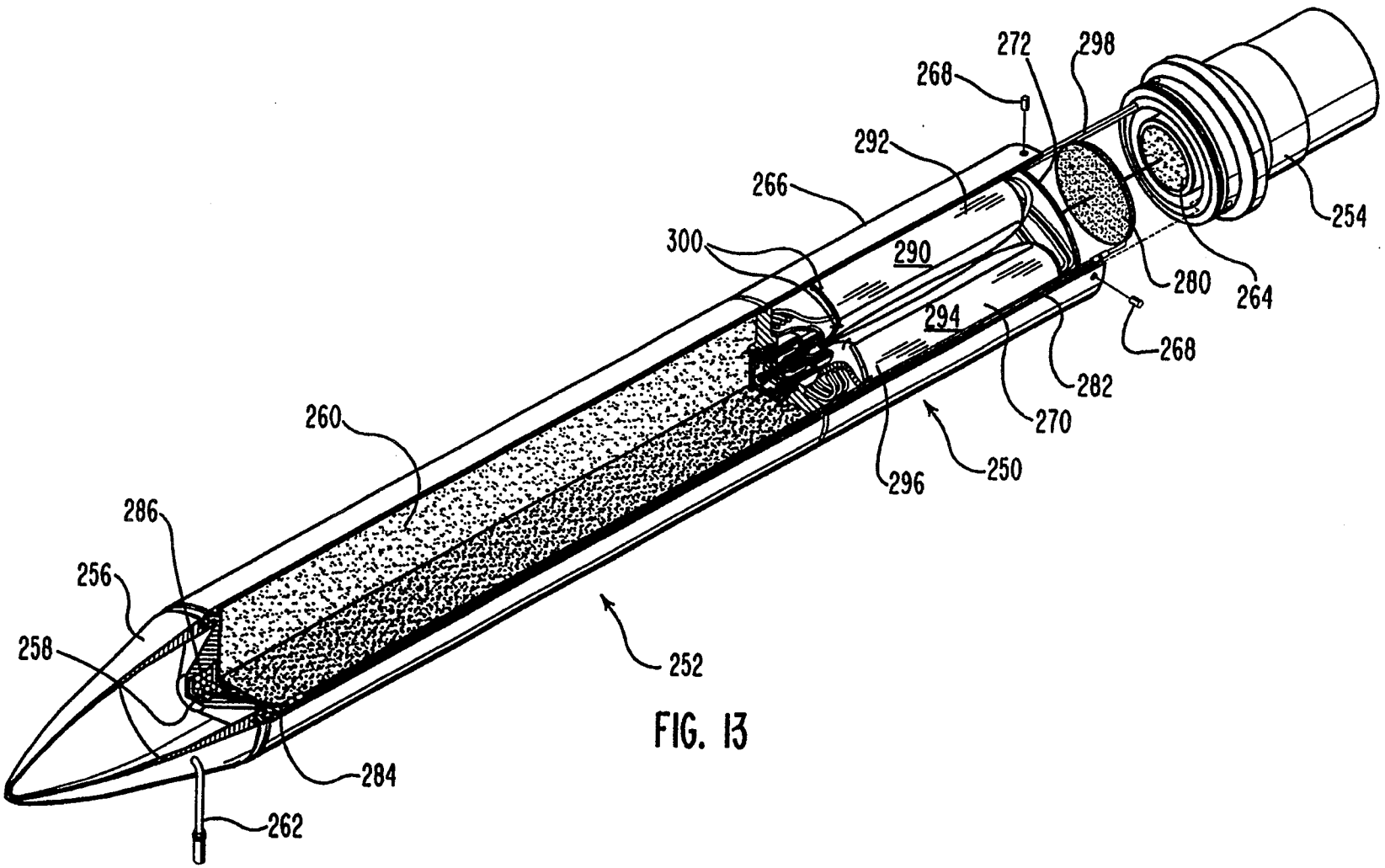
FIG. 13 is a partially exploded perspective view of a flare warhead configured with an alternative embodiment of the parachute deployment system of the present invention, with portions cut away to more clearly illustrate the invention.

An alternative embodiment of the parachute deployment system of the present invention is illustrated at 250 in FIG. 13. This embodiment is designed particularly for use with flare warheads utilizing a nose cone, as the parachute deployment system permits the total length of the warhead to be decreased even more than in the previously described embodiment.

As illustrated in FIG. 13, a warhead 252 incorporating the parachute deployment system 250 includes a fuse (not shown) housed within a motor adapter 254. The fuse in warhead 252 is preferably a remote-set, variable delay fuse, such as the M439 available from Accudyne Corp. of Janesville, Wis.

At its head end, the warhead 252 includes a nose cone 256 in which is housed an illuminant igniter 258. The nose cone 256 is primarily for enhanced aerodynamic efficiency, providing increased standoff range for the warhead. The ogive shape of the nose cone 256 is substantially identical to the nose cone on the M261 Multipurpose Submunition.

At the base of the illuminant igniter 258 is located the flare illuminant 260. A coaxial umbilical cable 262 extends out of the nose cone 256 and provides electrical connection to the fuse in much the same manner as described in connection with the embodiment of FIGS. 5 through 12.

As with the previously described embodiment, a separation charge 264 is positioned contiguous the fuse such that firing of the fuse will ignite the separation charge 264. The flare canister 266 is made of 0.050 inch thick 6061-T6 aluminum tubing and is attached to the motor adapter 254 by four shear pins 268. The strength, size and number of shear pins 268 utilized are selected such that they will easily shear when subjected to the shear forces imposed by the gas pressure of the fired separation charge 264.

Warhead 252 has a maximum flight velocity of 1100 m/s. The maximum flight velocity determines the amount of area drag opposing separation and thereby influences the number of shear pins and the size of propellant charge needed to ensure separation. In this embodiment, it is preferred to utilize a separation charge of about 5.8 grams of M-9 propellant. Such a separation charge generates only 500 psi of internal gas pressure. By minimizing the gas pressure resulting from the firing of the separation charge, unintentional firing of the separation charge will result in dispersion of parts of no more than 50 feet, in accordance with Insensitive Munition requirements.

Upon the firing of separation charge 264, the entire parachute cavity 270 is pressurized. A flexible elastomeric thermal barrier 272 is provided between the separation charge 264 and the parachute system 250 to insulate the parachute system from the hot gasses generated from the firing of the separation charge 264.

Warhead 252 further employs a novel illuminant ignition system for igniting the illuminant 260 upon the firing of the separation charge 264. A complete disclosure of this novel ignition system is provided in U.S. patent application for Combustible Flare Ignition System invented by Evan E. Day and filed on Nov. 12, 1992 as Ser. No. 07/974,746 That disclosure is specifically incorporated herein by this reference.

Briefly, the illuminant ignition system includes a Hivelite® pickup charge 280 positioned contiguous the separation charge 264 which is initiated upon the firing of the separation charge 264. The pickup charge 280 extends to a continuous thin-layer explosive train 282 such that the shock resulting from the firing of the pickup charge 280 will detonate the explosive train 282.

The explosive train 282 extends along the canister 266 adjacent the parachute system 250 and the illuminant 260. At the head end of the warhead, the explosive train connects to an output charge 284. Explosive train 282 has a combustion velocity of about 5,000 ft/sec. Thus, the explosive shock from the pickup charge 280 is virtually instantaneously transferred along the length of the warhead to the output charge 284.

The explosive shock of the explosive train 282 is sufficient to initiate combustion of the output charge 284. The output charge 284 transfers the combustion to a $BKNO_3$ pellet basket 286. Upon firing of the pellet basket 286, illuminant ignition proceeds substantially as previously described in connection with the embodiment of FIGS. 5 through 12.

Parachute deployment system 250 employs the same two-stage parachute system as does the previously described embodiment. Thus, it includes a drogue parachute pack 290, having a drogue parachute and a drogue parachute cover 292, positioned in a side-by-side, detached relationship with a main parachute pack 294 which includes a main parachute and a main parachute cover 296.

An extraction line 298, such as a metal cable, is attached to the motor adapter 254 by threading it into the interior edge adjacent the separation charge 264. The extraction line 298 extends past the pickup charge 280 and the thermal barrier 272 and connects to the drogue parachute cover 292. Thus, as the rocket motor and motor adapter 254 are separated from the warhead 252, the extraction line 298 extracts the drogue parachute pack 290 from the canister 266. Further separation causes the main parachute pack 294 to be extracted. As the lines become taut, the cotton ties 300 which hold the drogue parachute within the drogue parachute cover 292 break and permit the drogue parachute to deploy and inflate.

Because warhead 252 does not include a pusher plate, the drogue parachute cover 292 acts as the motor deflector. Thus, as the cotton ties 300 break, the drogue parachute cover 292 is subjected to the substantial forces of wind resistance imposed by the atmosphere. The wind resistance forces the droque chute cover 292 alongside the motor adapter 254 where it acts as a motor deflector. The aerodynamic forces acting on the drogue chute cover 292 cause the rocket motor to deviate from the path being traveled by the flare, thereby preventing the rocket motor from colliding with the flare.

Following extraction of the parachute packs as described above, further deployment of the parachute system proceeds substantially as explained previously in connection with the embodiment of FIGS. 5 through 12.

Figure 14:
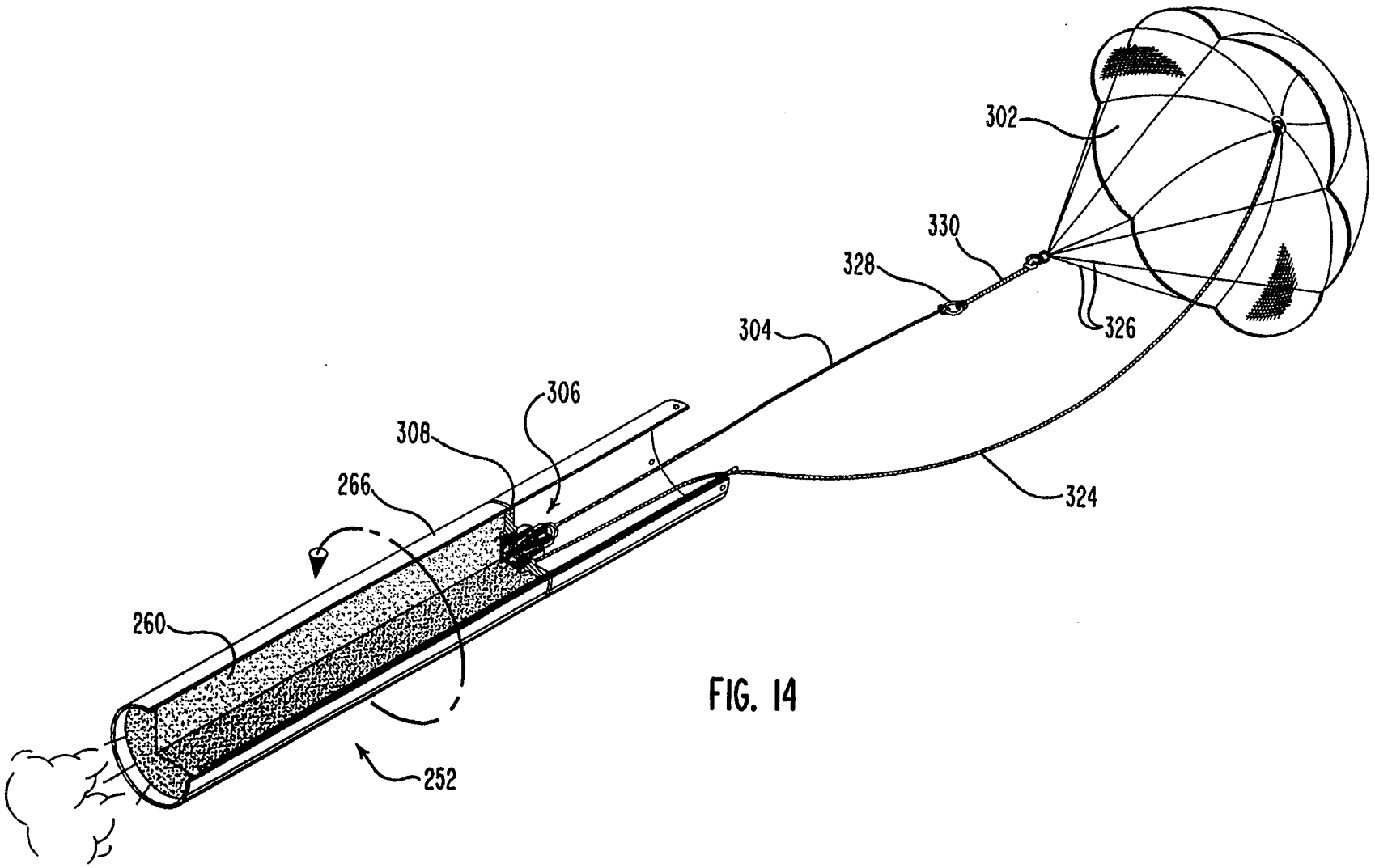
FIG. 14 is a perspective view of the warhead of FIG. 13 following deployment of the main parachute, with portions cut away to more clearly illustrate the invention.
Figure 15:
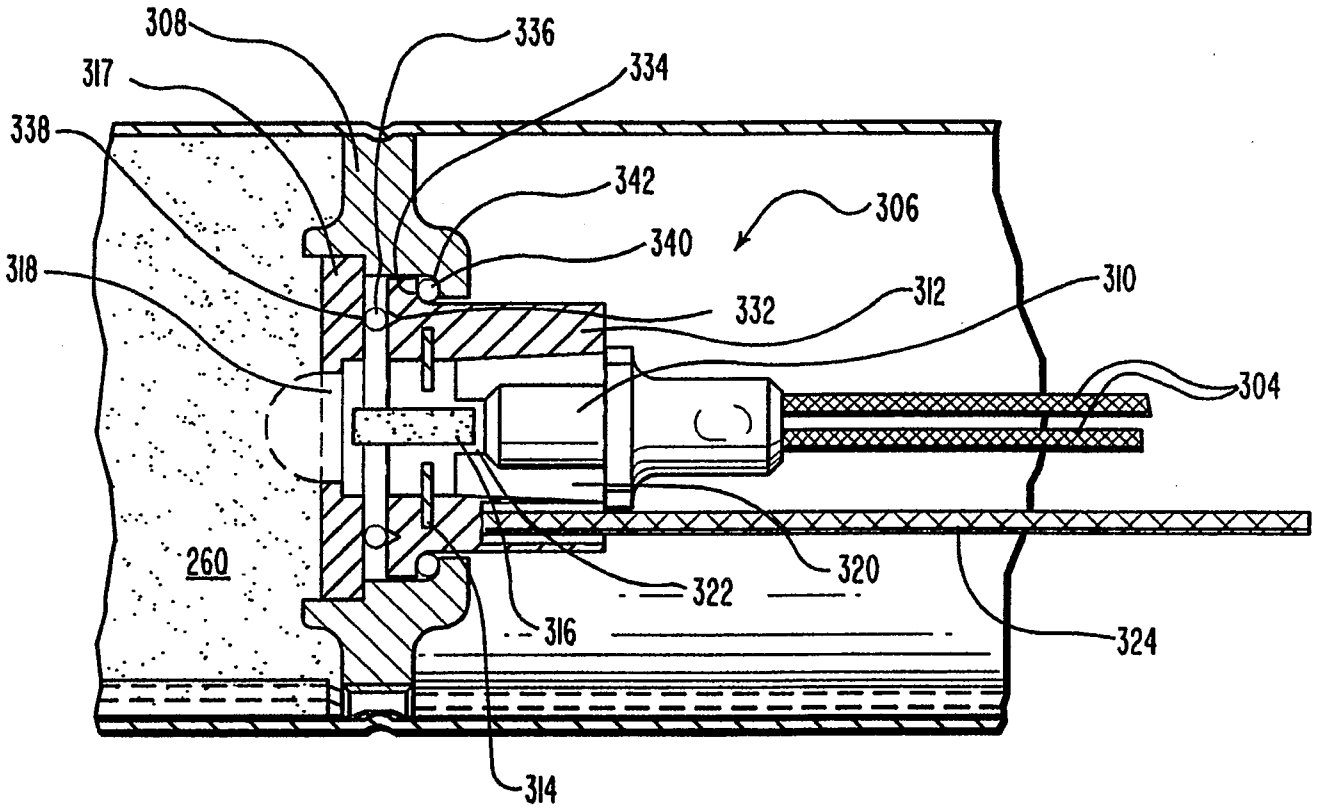
FIG. 15 is a cross-sectional view taken along line 15—15 of FIG. 14, illustrating the exploding bolt assembly.

As illustrated in FIG. 14, the main parachute 302 is supported by a main parachute line 304 which connects to an exploding bolt assembly 306 attached to the bulkhead 308. As illustrated in greater detail in FIG. 15, the exploding bolt assembly includes a bolt 310 which is mounted in a housing 312 by a snap ring 314. A detonator 316 is positioned in the base of bolt 310 and is in open communication with the aft end of the illuminant 260 through an opening 318 in the base plate 317.

Thus, upon burnout of the flare illuminant 260, the burning illuminant 260 ignites the detonator 316. Firing of the detonator 316 shatters the neck 322 of the bolt 310, thereby releasing the main parachute line 304.

A tether line 324 is connected at one end to the exploding bolt assembly 306 adjacent cavity 320 and at the other end to the top of the inside of the main parachute 302 (FIG. 14). Thus, upon release of the main parachute line 304, the main parachute 302 is immediately inverted and collapsed. With the tether 324 still connecting the main parachute 302 to the now-empty flare canister, the parachute 302 and the empty flare canister 266 quickly fall together to the ground. By attaching the main parachute 302 to the empty flare canister 266, the parachute is not permitted to "float" to the ground. Hence, foreign object debris over the target area is minimized and the risk that the parachute could interfere with aircraft over the target area is reduced.

One of skill in the art will appreciate that other varieties of a tether may be incorporated. These include, but are not limited to, those tether embodiments disclosed in U.S. Pat. No. 4,765,247 to Sorensen et al. and incorporated herein by this reference. Thus, it may be desirable to substitute the tether line for a second main parachute support line which is attached to half of the main parachute shroud lines 326, with the main support line 304 attached to the remainder of the shroud lines 326.

The warhead 252 has a peak spin rate of approximately 55 revolutions per second. Thus, without an effective swivel assembly, the shroud lines 326 of the main parachute 302 will wind together and collapse the main parachute 302. Further, the swivel must permit the tether 324 to rotate with the main parachute line 304. Because of the need to incorporate the tether 324 into the swivel assembly, this embodiment does not incorporate a swivel at the main bridle 328. Thus, the main line 330 connects directly to the bridle 328 rather than connecting to a swivel assembly as with the previously described embodiment.

With reference again to FIG. 15, the housing 312 of the exploding bolt assembly 306 is configured with a V-groove 332 along its base and a shoulder 334 opposite the V-groove 332. Bearings 336 are placed between the housing 312 and the bulkhead 308 such that the bearings 336 ride in the V-groove 332 and against a platform 338 on the base plate 317. A second set of bearings 340 ride between a shoulder 342 configured in the bulkhead 308 and shoulder 334 in the housing 312.

The exploding bolt assembly 306 thus permits the entire housing 312 to rotate relative to the flare canister 266. As the tether 324 is mounted in the housing 312, the tether 324 rotates with the main parachute line 304 which is also connected to the housing 312.

From the foregoing, it can be seen that the present invention provides a parachute deployment system which incorporates an improved rocket motor deflector to thereby ensure that the rocket motor will not collide with the flare following its separation from the flare. Also, the present invention provides a novel parachute deployment system which enables the overall length of the warhead to be reduced without reducing the amount of illuminant included within the flare to thereby enable aerodynamic fairings to be used on the launcher and a nose cone to be used on the warhead. Additionally, the present invention provides an improved parachute deployment system which is configured with a novel ignition lanyard mounting to ensure that the flare ignition system is fired regardless of the velocity at which the main parachute is deployed.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A parachute deployment system for use in a warhead, comprising:

a warhead including a motor adapter configured for separably attaching a motor to the warhead;

a main parachute coupled to said warhead;

a fabric deflector being positioned within the warhead;

a pusher plate;

a first extraction line coupling said motor adapter to said pusher plate; and a second extraction line coupling said pusher plate to said fabric deflector such that upon separation of the warhead from the motor adapter, said fabric deflector is extracted from the warhead and causes radial forces to act upon the motor adapter to alter the direction of travel of the motor.

2. A parachute deployment system as defined in claim 1, wherein said fabric deflector is a parachute cover.

3. A parachute deployment system as defined in claim 2, wherein said parachute cover is a drogue parachute cover.

4. A parachute deployment system as defined in claim 1, further comprising an ignition lanyard coupled to an ignition system actuated by the pull of said ignition lanyard, said ignition lanyard separably coupled to the motor adapter such that separation of the warhead from the motor adapter applies a force to said ignition lanyard tending to pull said ignition lanyard.

5. A parachute deployment system as defined in claim 4, further comprising a drogue parachute separably coupled to the warhead said ignition lanyard coupled to said drogue parachute and to said main parachute such that deployment of said drogue parachute and said main parachute applies a force to said ignition lanyard tending to pull said ignition lanyard.

6. A parachute deployment system as defined in claim 1, wherein said first extraction line is attached to said pusher plate in substantially the same location as said second extraction line is attached to said pusher plate, such that said first extraction line is substantially collinear with said second extraction line when said first and said second extraction lines are extended.

7. A parachute deployment system as defined in claim 6, wherein said first and said second extraction lines are both attached to said pusher plate at substantially the center of said pusher plate.

8. A parachute deployment system as defined in claim 7, wherein said first extraction line extends through the center of said pusher plate and attaches to a head side of said pusher plate.

9. A parachute deployment system as defined in claim 8, wherein said pusher plate is configured with a hole in the center to accommodate said first extraction line and said hole is filled with a sealant.

10. A parachute deployment system as defined in claim 9, wherein said sealant comprises a polymeric adhesive.

11. A parachute deployment system for use with a warhead, comprising:

a warhead including an extraction implement capable of separation from the warhead to promote deployment of the system;

a main parachute pack including a main parachute arranged within a main chute cover;

a drogue parachute pack including a drogue parachute arranged within a drogue chute cover, said main parachute pack and said drogue parachute pack configured to be positioned in a side-by-side, detached relationship within the warhead;

an extraction line coupling said drogue parachute pack to the extraction implement; and a support line coupling said drogue parachute pack to said main parachute pack and coupling said main parachute pack to the warhead such that upon separation of the extraction implement from the warhead, said drogue parachute pack is extracted from the warhead prior to extraction of said main parachute pack.

12. A parachute deployment system as defined in claim 11, wherein said main parachute pack and said drogue parachute pack have a fore end and an aft end and said support line is connected to said fore end of said drogue parachute pack and to said aft end of said main parachute pack.

13. A parachute deployment system as defined in claim 11, further comprising a separation charge which when fired causes separation of the extraction implement from the warhead and a thermal barrier positioned between said separation charge and said main and drogue parachute packs.

14. A parachute deployment system as defined in claim 11, wherein said support line is connected to said drogue parachute.

15. A parachute deployment system as defined in claim 11, further comprising an ignition lanyard coupled to an ignition system actuated by the pull of said ignition lanyard, said ignition lanyard separably coupled to the extraction implement such that separation of the extraction implement from the warhead applies a force to said ignition lanyard tending to pull said ignition lanyard.

16. A parachute deployment system as defined in claim 15, wherein the ignition lanyard is coupled to said drogue parachute.

17. A parachute deployment system as defined in claim 11, wherein said support line is severable into a first support line and a second support line, said first support line coupling said drogue parachute to said main chute cover and said second support line coupling the main parachute to the warhead, such that upon severance of said support line said main parachute is removed from said main chute cover thereby permitting said main parachute to deploy.

18. A parachute deployment system as defined in claim 17, wherein said second support line includes a swivel configured to permit the warhead to rotate with respect to said main parachute.

19. A parachute deployment system as defined in claim 18, further comprising an ignition lanyard connected to an ignition system actuated by the pull of said ignition lanyard, said lanyard connected to said swivel such that deployment of said drogue parachute applies a force to said ignition lanyard tending to pull said ignition lanyard.

20. A parachute deployment system as defined in claim 18, wherein said second support line is connected to the warhead by attachment to said swivel.

21. A parachute deployment system as defined in claim 11, further comprising a pusher plate mounted on said extraction line between said drogue parachute pack and the extraction implement.

22. A parachute deployment system as defined in claim 21, wherein said extraction line comprises a first extraction line coupling the extraction implement to said pusher plate and a second extraction line coupling said pusher plate to said drogue parachute pack.

23. A parachute deployment system as defined in claim 22, wherein said first extraction line is attached to said pusher plate in substantially the same location as said second extraction line is attached to said pusher plate, such that said first extraction line is substantially collinear with said second extraction line when said first and said second extraction lines are extended.

24. A parachute deployment system as defined in claim 23, wherein said first and said second extraction lines are both attached to said pusher plate at substantially the center of said pusher plate.

25. A parachute deployment system as defined in claim 24, wherein said first extraction line extends through the center of said pusher plate and attaches to a head side of said pusher plate.

* * * * *